US010670004B2

(12) United States Patent
Bae et al.

(10) Patent No.: US 10,670,004 B2
(45) Date of Patent: Jun. 2, 2020

(54) LINEAR COMPRESSOR

(71) Applicant: LG ELECTRONICS INC., Seoul (KR)

(72) Inventors: Sangeun Bae, Seoul (KR); Jeonguk Byun, Seoul (KR); Kyungmin Lee, Seoul (KR); Gyeoungjin Jeon, Seoul (KR); Dongkyun Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 293 days.

(21) Appl. No.: 15/493,291

(22) Filed: Apr. 21, 2017

(65) Prior Publication Data

US 2017/0321692 A1 Nov. 9, 2017

(30) Foreign Application Priority Data

May 3, 2016 (KR) ..... 10-2016-0054865

(51) Int. Cl.

*F04B 39/12* (2006.01)
*F04B 39/00* (2006.01)
*F04B 35/04* (2006.01)

(52) U.S. Cl.

CPC ..... *F04B 39/0027* (2013.01); *F04B 35/045* (2013.01); *F04B 39/0055* (2013.01); *F04B 39/121* (2013.01); *F04B 39/123* (2013.01); *F04B 39/125* (2013.01)

(58) Field of Classification Search

CPC ..... F04B 7/0084; F04B 7/02; F04B 11/00; F04B 11/0091; F04B 17/04; F04B 17/044; F04B 35/045; F04B 39/0027; F04B 39/0033; F04B 39/0038; F04B 39/0055; F04B 39/0061; F04B 39/121; F04B 39/123; F04B 39/125; F04B 53/001; F04B 53/002; F04B 53/162; F16K 15/00; F16K 15/02; F16K 15/021; F16K 15/023; F16K 27/12; F16K 47/08; F16K 47/10

USPC ..... 417/312, 417, 540; 137/565.11, 137/565.13–565.15

See application file for complete search history.

(56) References Cited

U.S. PATENT DOCUMENTS 6,824,365 B2 * 11/2004 Park ..... F04B 39/0061 181/403
9,845,797 B2 * 12/2017 Ki ..... F04B 49/20
2006/0093498 A1 5/2006 Kim
2010/0266429 A1 * 10/2010 Kang ..... F04B 39/0088 417/417

(Continued)

FOREIGN PATENT DOCUMENTS

CN 1444697 9/2003
CN 101835976 9/2010

(Continued)

OTHER PUBLICATIONS

Chinese Office Action dated Aug. 28, 2018 issued in Application No. 201710287747.3 (English Translation Attached).

(Continued)

*Primary Examiner* — Patrick Hamo
*Assistant Examiner* — Chirag Jariwala
(74) *Attorney, Agent, or Firm* — Ked & Associates LLP

(57) ABSTRACT

A linear compressor is provided. The linear compressor may include a discharge cover including a plurality of covers stacked in an axial direction.

18 Claims, 15 Drawing Sheets

(56) References Cited

U.S. PATENT DOCUMENTS

| | | | | |
|---|---|---|---|---|
| 2010/0310389 | A1* | 12/2010 | Alvarenga | F01N 1/089<br>417/312 |
| 2018/0347555 | A1* | 12/2018 | De Bortoli | F04B 39/0061 |

FOREIGN PATENT DOCUMENTS

| | | | | |
|---|---|---|---|---|
| CN | 101932835 | | 12/2010 | |
| CN | 203835658 | | 9/2014 | |
| CN | 106979137 | | 7/2017 | |
| CN | 107304759 | | 10/2017 | |
| DE | 10317459 | A1 * | 11/2004 | F04B 39/122 |
| JP | 2011-094569 | | 5/2011 | |
| KR | 10-130768 | | 5/2009 | |
| KR | 10-2016-0000324 | | 1/2016 | |
| KR | 10-2016-0001055 | | 1/2016 | |
| WO | WO 02/095231 | | 11/2002 | |
| WO | WO 2014/053039 | | 4/2014 | |

OTHER PUBLICATIONS

European Search Report dated Sep. 29, 2017 issued in Application No. 17167727.1.

Chinese Office Action dated Aug. 27, 2019 with English Translation.

* cited by examiner

LINEAR COMPRESSOR

CROSS-REFERENCE TO RELATED APPLICATION(S)

The present application claims priority under 35 U.S.C. 119 and 35 U.S.C. 365 to Korean Patent Application No. 10-2016-0054865 filed in Korea on May 3, 2016, which is hereby incorporated by reference in its entirety.

BACKGROUND

1. Field

A linear compressor is disclosed herein.

2. Background

Cooling systems are systems in which a refrigerant circulates to generate cool air. In such a cooling system, processes of compressing, condensing, expanding, and evaporating the refrigerant are repeatedly performed. For this, the cooling system includes a compressor, a condenser, an expansion device, and an evaporator. Also, the cooling system may be installed in a refrigerator or air conditioner which is a home appliance.

In general, compressors are machines that receive power from a power generation device, such as an electric motor or a turbine, to compress air, a refrigerant, or various working gases, thereby increasing pressure. Compressors are being widely used in home appliances or industrial fields.

Compressors may be largely classified into reciprocating compressors, in which a compression space into/from which a working gas is suctioned and discharged, is defined between a piston and a cylinder to allow the piston to be linearly reciprocated into the cylinder, thereby compressing a refrigerant, rotary compressors, in which a compression space into/from which a working gas is suctioned or discharged, is defined between a roller that eccentrically rotates and a cylinder to allow the roller to eccentrically rotate along an inner wall of the cylinder, thereby compressing a refrigerant, and scroll compressors, in which a compression space into/from which a refrigerant is suctioned or discharged, is defined between an orbiting scroll and a fixed scroll to compress a refrigerant while the orbiting scroll rotates along the fixed scroll. In recent years, a linear compressor, which is directly connected to a drive motor, in which a piston linearly reciprocates, to improve compression efficiency without mechanical losses due to movement conversion, and having a simple structure, is being widely developed. In general, the linear compressor may suction and compress a refrigerant while a piston linearly reciprocates in a sealed shell by a linear motor and then discharge the refrigerant.

The linear motor is configured to allow a permanent magnet to be disposed between an inner stator and an outer stator. The permanent magnet may linearly reciprocate by an electromagnetic force between the permanent magnet and the inner (or outer) stator. Also, as the permanent magnet operates in the state in which the permanent magnet is connected to the piston, the permanent magnet may suction and compress the refrigerant while linearly reciprocating within the cylinder and then discharge the refrigerant.

The present applicant has filed a patent (hereinafter, referred to as "Prior Art Document 1") and then has registered the patent with respect to the linear compressor, Korean Patent Registration No. 10-1307688, registered on Sep. 5, 2013 and entitled "LINEAR COMPRESSOR", which is hereby incorporated by reference. The linear compressor according to the Prior Art Document 1 includes a shell for accommodating a plurality of parts. A vertical height of the shell may be somewhat high as illustrated in FIG. 2 of the Prior Art Document 1. Also, an oil supply assembly for supplying oil between a cylinder and a piston may be disposed within the shell.

When the linear compressor is provided in a refrigerator, the linear compressor may be disposed in a machine room provided at a rear side of the refrigerator. In recent years, a major concern of a customer is increasing an inner storage space of the refrigerator. To increase the inner storage space of the refrigerator, it may be necessary to reduce a volume of the machine room. Also, to reduce the volume of the machine room, it may be important to reduce a size of the linear compressor.

However, as the linear compressor disclosed in the Prior Art Document 1 has a relatively large volume, it is necessary to increase a volume of a machine room into which the linear compressor is accommodated. Thus, the linear compressor having a structure disclosed in the Prior Art Document 1 is not adequate for the refrigerator for increasing the inner storage space thereof.

To reduce the size of the linear compressor, it may be necessary to reduce a size of a main part or component of the compressor. In this case, performance of the compressor may deteriorate. To compensate for the deteriorated performance of the compressor, the compressor drive frequency may be increased. However, the more the drive frequency of the compressor is increased, the more a friction force due to oil circulating into the compressor increases, deteriorating performance of the compressor.

To solve these limitations, the present applicant has filed a patent application (hereinafter, referred to as "Prior Art Document 2"), Korean Patent Publication No. 10-2016-0000324 published on Jan. 4, 2016, and entitled "LINEAR COMPRESSOR", which is hereby incorporated by reference. In the linear compressor of the Prior Art Document 2, a gas bearing technology in which a refrigerant gas is supplied in a space between a cylinder and a piston to perform a bearing function is disclosed. The refrigerant gas flows to an outer circumferential surface of the piston through a nozzle of the cylinder to act as a bearing in the reciprocating piston.

The linear compressor disclosed in the Prior Art Document 2 includes a discharge cover to which a discharge valve is coupled. A discharge space through which a compression refrigerant discharged through the discharge valve flows is defined in the discharge cover. However, in the structure of the discharge cover according to the related art, there are limitations in which the discharge space has a relatively small volume, a discharge passage through which the compression refrigerant flows has a short length, and pulsation due to a flow of the refrigerant increases. The discharge cover or peripheral parts or components coupled to the discharge cover may be vibrated by the pulsation of the generated refrigerant gas, and the vibration may be transmitted to a shell through a support device supporting the discharge cover, causing vibration in the entire compressor and thereby generating resulting noise.

BRIEF DESCRIPTION OF THE DRAWINGS

Embodiments will be described in detail with reference to the following drawings in which like reference numerals refer to like elements, and wherein.

DETAILED DESCRIPTION

Hereinafter, exemplary embodiments will be described with reference to the accompanying drawings. The embodiments may, however, be embodied in many different forms and should not be construed as being limited to the embodiments set forth herein; rather, that alternate embodiments included in other retrogressive inventions or falling within the spirit and scope of the present disclosure will fully convey the concept to those skilled in the art.

Figure 1:
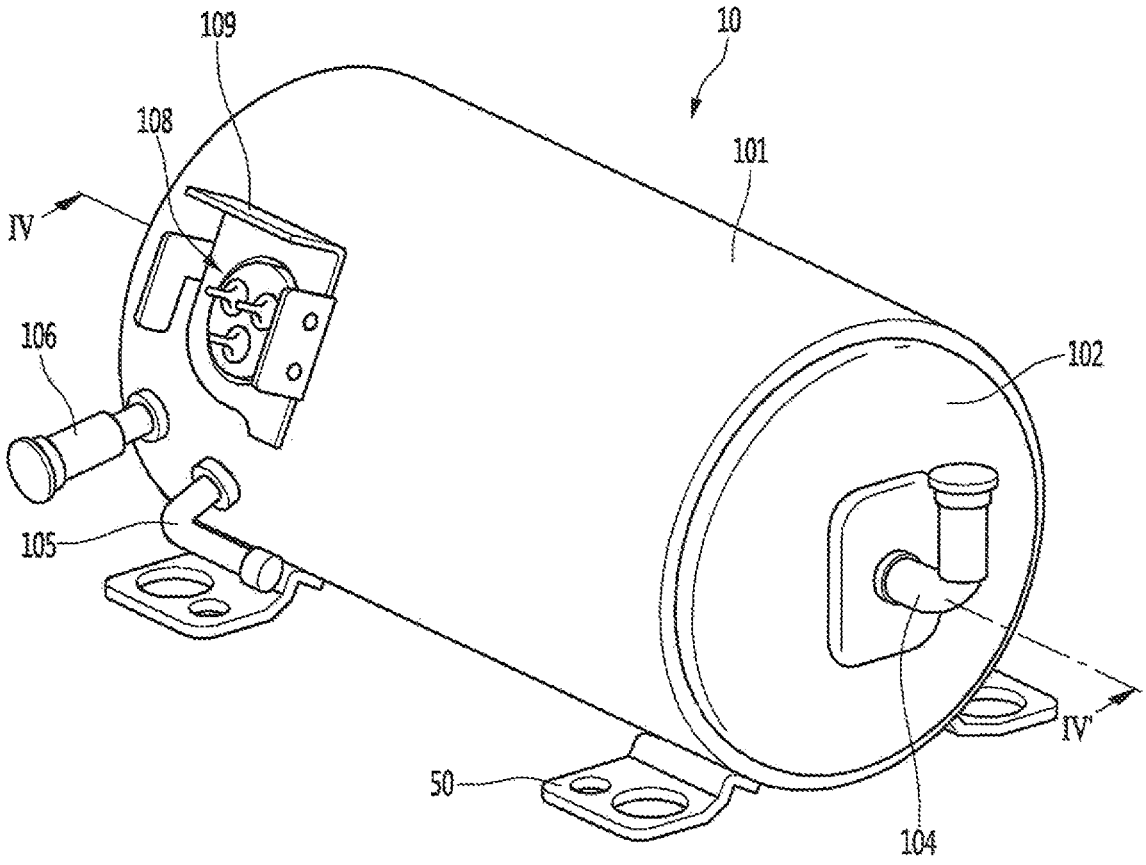
FIG. 1 is a perspective view illustrating an outer appearance of a linear compressor according to an embodiment.
Figure 2:
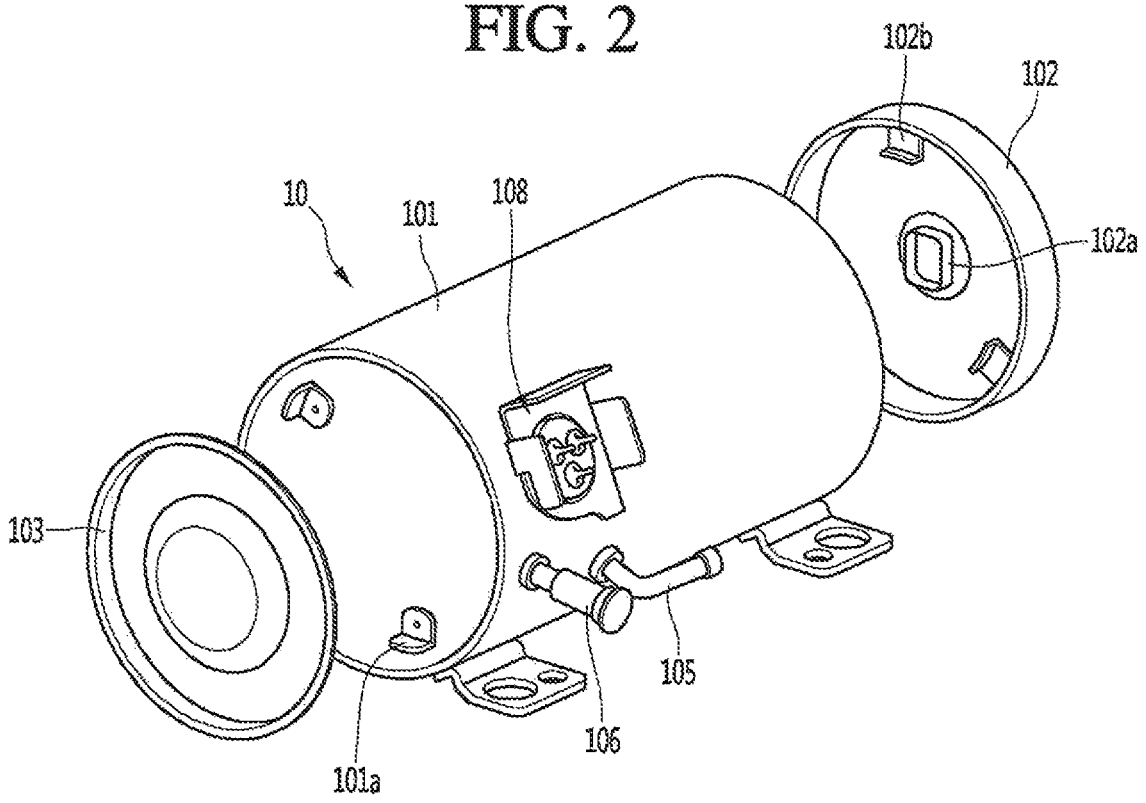
FIG. 2 is an exploded perspective view illustrating a shell and a shell cover of the linear compressor according to an embodiment.

FIG. 1 is a perspective view illustrating an outer appearance of a linear compressor according to an embodiment. FIG. 2 is an exploded perspective view illustrating a shell and a shell cover of the linear compressor according to an embodiment.

Referring to FIGS. 1 and 2, a linear compressor 10 according to an embodiment may include a shell 101 and shell covers 102 and 103 coupled to the shell 101. Each of the first and second shell covers 102 and 103 may be understood as one component of the shell 101.

A leg 50 may be coupled to a lower portion of the shell 101. The leg 50 may be coupled to a base of a product in which the linear compressor 10 is installed or provided. For example, the product may include a refrigerator, and the base may include a machine room base of the refrigerator. For another example, the product may include an outdoor unit of an air conditioner, and the base may include a base of the outdoor unit.

The shell 101 may have an approximately cylindrical shape and be disposed to lie in a horizontal direction or an axial direction. In FIG. 1, the shell 101 may extend in the horizontal direction and have a relatively low height in a radial direction. That is, as the linear compressor 10 has a low height, when the linear compressor 10 is installed or provided in the machine room base of the refrigerator, a machine room may be reduced in height.

A terminal 108 may be installed or provided on an outer surface of the shell 101. The terminal 108 may be understood as a component for transmitting external power to a motor assembly (see reference numeral 140 of FIG. 3) of the linear compressor 10. The terminal 108 may be connected to a lead line of a coil (see reference numeral 141*c* of FIG. 3).

A bracket 109 may be installed or provided outside of the terminal 108. The bracket 109 may include a plurality of brackets that surrounds the terminal 108. The bracket 109 may protect the terminal 108 against an external impact.

Both sides of the shell 101 may be open. The shell covers 102 and 103 may be coupled to both open sides of the shell 101. The shell covers 102 and 103 may include a first shell cover 102 coupled to one open side of the shell 101 and a second shell cover 103 coupled to the other open side of the shell 101. An inner space of the shell 101 may be sealed by the shell covers 102 and 103.

In FIG. 1, the first shell cover 102 may be disposed at a first or right portion of the linear compressor 10, and the second shell cover 103 may be disposed at a second or left portion of the linear compressor 10. That is, the first and second shell covers 102 and 103 may be disposed to face each other.

The linear compressor 10 further includes a plurality of pipes 104, 105, and 106 provided in the shell 101 or the shell covers 102 and 103 to suction, discharge, or inject the refrigerant. The plurality of pipes 104, 105, and 106 may include a suction pipe 104 through which the refrigerant may be suctioned into the linear compressor 10, a discharge pipe 105 through which the compressed refrigerant may be discharged from the linear compressor 10, and a process pipe through which the refrigerant may be supplemented to the linear compressor 10.

For example, the suction pipe 104 may be coupled to the first shell cover 102. The refrigerant may be suctioned into the linear compressor 10 through the suction pipe 104 in an axial direction.

The discharge pipe 105 may be coupled to an outer circumferential surface of the shell 101. The refrigerant suctioned through the suction pipe 104 may flow in the axial direction and then be compressed. Also, the compressed refrigerant may be discharged through the discharge pipe 105. The discharge pipe 105 may be disposed at a position which is adjacent to the second shell cover 103 rather than the first shell cover 102.

The process pipe 106 may be coupled to the outer circumferential surface of the shell 101. A worker may inject the refrigerant into the linear compressor 10 through the process pipe 106.

The process pipe 106 may be coupled to the shell 101 at a height different from a height of the discharge pipe 105 to avoid interference with the discharge pipe 105. The height may be understood as a distance from the leg 50 in the vertical direction (or the radial direction). As the discharge pipe 105 and the process pipe 106 are coupled to the outer circumferential surface of the shell 101 at the heights different from each other, a worker's work convenience may be improved.

At least a portion of the second shell cover 103 may be disposed adjacent to an inner circumferential surface of the shell 101, which corresponds to a point to which the process pipe 106 may be coupled. That is, at least a portion of the second shell cover 103 may act as a flow resistance to the refrigerant injected through the process pipe 106.

Thus, in view of the passage of the refrigerant, the passage of the refrigerant introduced through the process pipe 106 may have a size that gradually decreases toward the inner space of the shell 101. In this process, a pressure of the refrigerant may be reduced to allow the refrigerant to be vaporized. Also, in this process, oil contained in the refrigerant may be separated. Thus, the refrigerant from which the oil is separated may be introduced into a piston 130 to improve compression performance of the refrigerant. The oil may be understood as a working oil existing in a cooling system.

A cover support part or support 102*a* may be disposed or provided on an inner surface of the first shell cover 102. A second support device or support 185, which will be described hereinafter, may be coupled to the cover support part 102*a*. The cover support part 102*a* and the second support device 185 may be understood as devices that support a main body of the linear compressor 10. The main body of the compressor may represent a part or portion provided in the shell 101. For example, the main body may include a drive part or drive that reciprocates forward and backward and a support part or support that supports the drive part. The drive part may include parts or components, such as the piston 130, a magnet frame 138, a permanent magnet 146, a support 137, and a suction muffler 150. Also, the support part may include parts or components, such as resonant springs 176*a* and 176*b*, a rear cover 170, a stator cover 149, a first support device or support 165, and a second support device or support 185.

A stopper 102*b* may be disposed or provided on the inner surface of the first shell cover 102. The stopper 102*b* may be understood as a component that prevents the main body of the compressor, particularly, the motor assembly 140 from being bumped by the shell 101 and thus damaged due to vibration or an impact occurring during transportation of the linear compressor 10. The stopper 102*b* may be disposed or provided adjacent to the rear cover 170, which will be described hereinafter. Thus, when the linear compressor 10 is shaken, the rear cover 170 may interfere with the stopper 102*b* to prevent the impact from being transmitted to the motor assembly 140.

A spring coupling part or portion 101*a* may be disposed or provided on the inner surface of the shell 101. For example, the spring coupling part 101*a* may be disposed at a position which is adjacent to the second shell cover 103. The spring coupling part 101*a* may be coupled to a first support spring 166 of the first support device 165, which will be described hereinafter. As the spring coupling part 101*a* and the first support device 165 are coupled to each other, the main body of the compressor may be stably supported inside of the shell 101.

Figure 3:
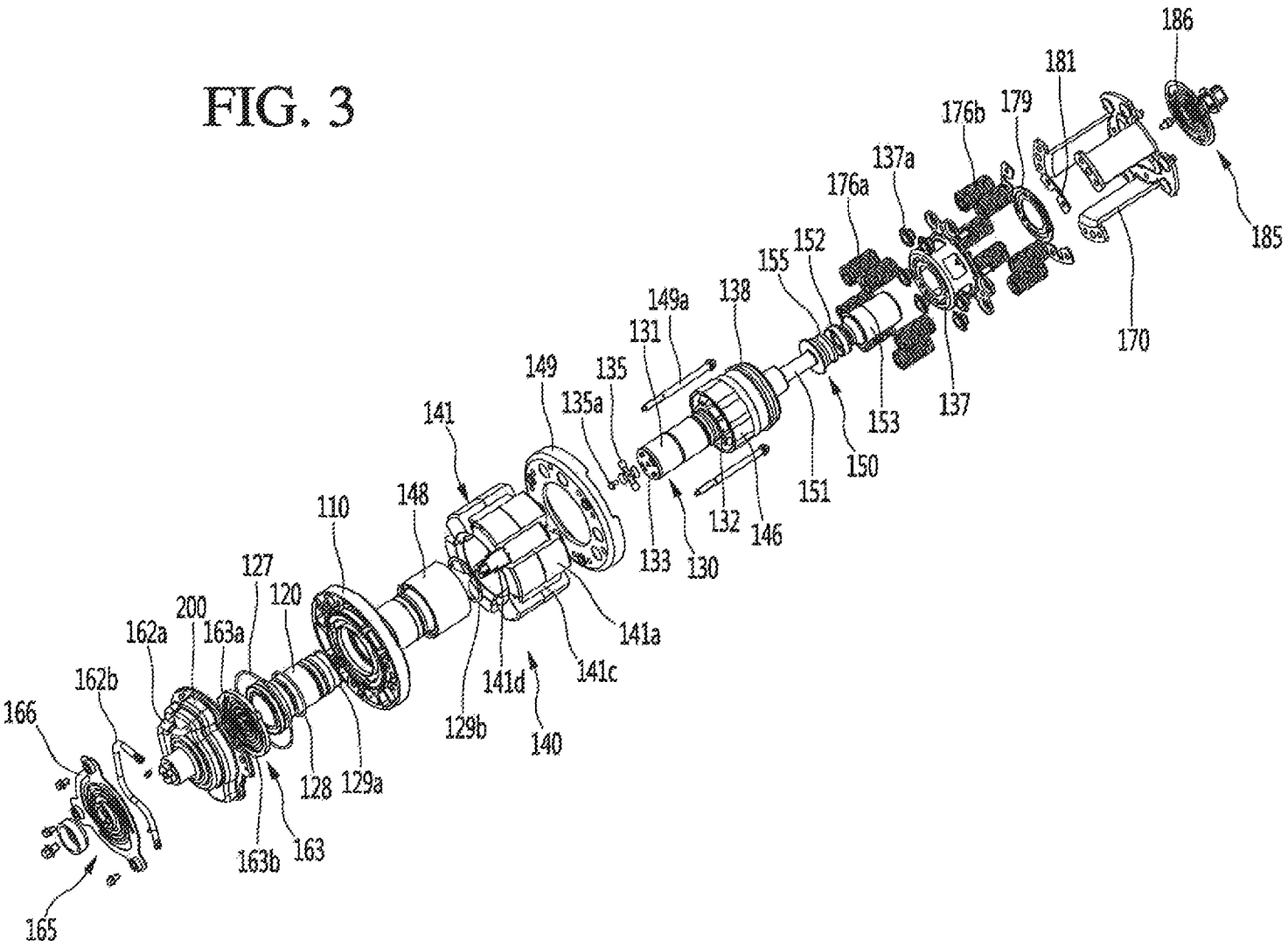
FIG. 3 is an exploded perspective view illustrating internal components of the linear compressor according to an embodiment.
Figure 4:
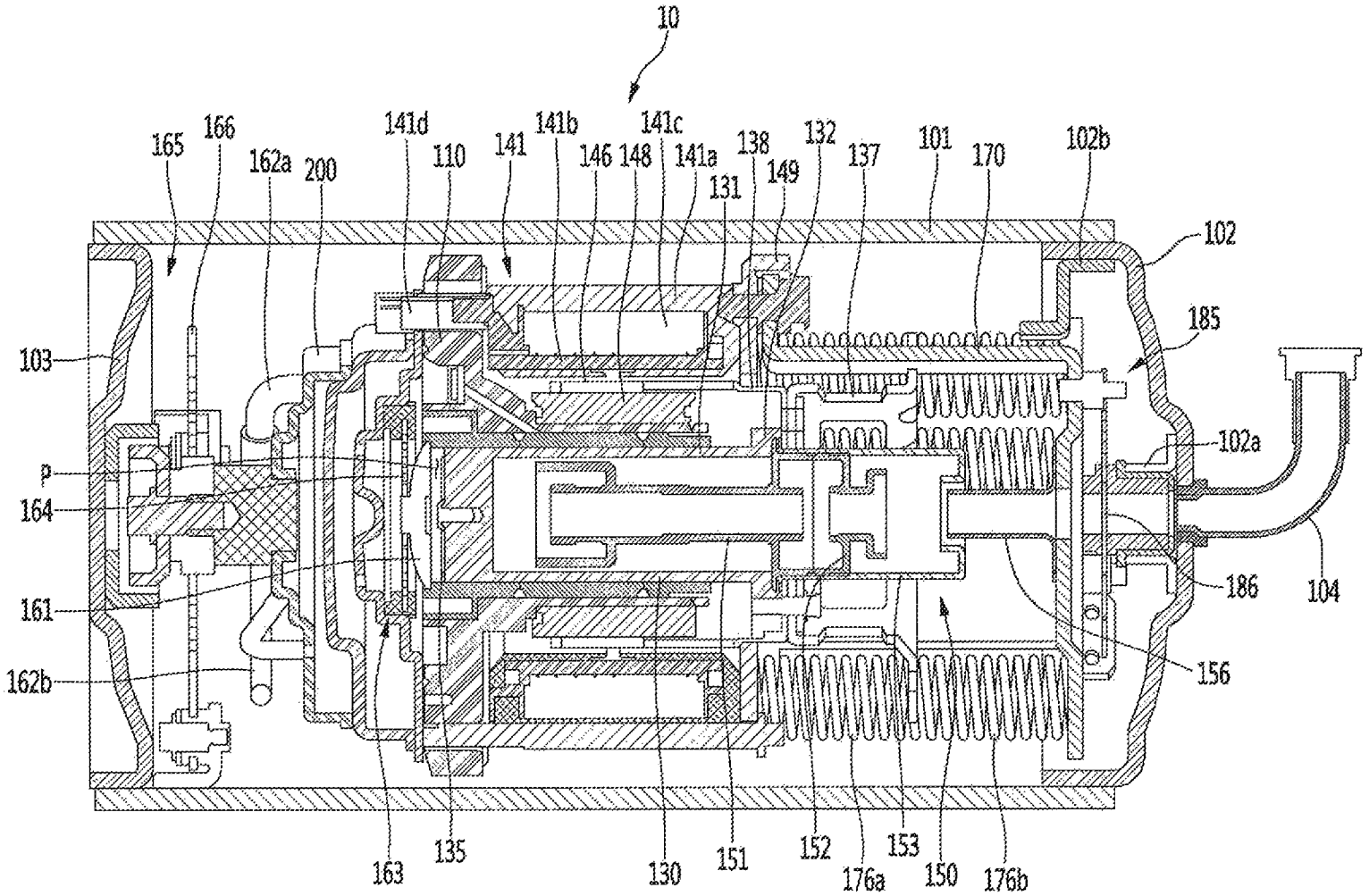
FIG. 4 is a cross-sectional view, taken along line IV-IV' of FIG. 1.

FIG. 3 is an exploded perspective view illustrating internal components of the linear compressor according to an embodiment. FIG. 4 is a cross-sectional view illustrating internal components of the linear compressor according to an embodiment.

Referring to FIGS. 3 and 4, the linear compressor 10 according to an embodiment may include a cylinder 120 provided in the shell 101, the piston 130, which linearly reciprocates within the cylinder 120, and the motor assembly 140, which functions as a linear motor to apply drive force to the piston 130. When the motor assembly 140 is driven, the piston 130 may linearly reciprocate in the axial direction.

The linear compressor 10 may further include a suction muffler 150 coupled to the piston 130 to reduce noise generated from the refrigerant suctioned through the suction pipe 104. The refrigerant suctioned through the suction pipe 104 may flow into the piston 130 via the suction muffler 150. For example, while the refrigerant passes through the suction muffler 150, the flow noise of the refrigerant may be reduced.

The suction muffler 150 may include a plurality of mufflers 151, 152, and 153. The plurality of mufflers 151, 152, and 153 may include a first muffler 151, a second muffler 152, and a third muffler 153, which may be coupled to each other.

The first muffler 151 may be disposed or provided within the piston 130, and the second muffler 152 may be coupled to a rear portion of the first muffler 151. Also, the third muffler 153 may accommodate the second muffler 152 therein and extend to a rear side of the first muffler 151. In view of a flow direction of the refrigerant, the refrigerant suctioned through the suction pipe 104 may successively pass through the third muffler 153, the second muffler 152, and the first muffler 151. In this process, the flow noise of the refrigerant may be reduced.

The suction muffler 150 may further include a muffler filter 155. The muffler filter 155 may be disposed on or at an interface on or at which the first muffler 151 and the second muffler 152 are coupled to each other. For example, the muffler filter 155 may have a circular shape, and an outer circumferential portion of the muffler filter 155 may be supported between the first and second mufflers 151 and 152.

The "axial direction" may be understood as a direction in which the piston 130 reciprocates, that is, a horizontal direction in FIG. 4. Also, "in the axial direction", a direction from the suction pipe 104 toward a compression space P, that is, a direction in which the refrigerant flows may be defined as a "frontward direction", and a direction opposite to the frontward direction may be defined as a "rearward direction". When the piston 130 moves forward, the compression space P may be compressed. On the other hand, the "radial direction" may be understood as a direction which is perpendicular to the direction in which the piston 130 reciprocates, that is, a vertical direction in FIG. 4.

The piston 130 may include a piston body 131 having an approximately cylindrical shape and a piston flange part or flange 132 that extends from the piston body 131 in the radial direction. The piston body 131 may reciprocate inside of the cylinder 120, and the piston flange part 132 may reciprocate outside of the cylinder 120.

The cylinder 120 may be configured to accommodate at least a portion of the first muffler 151 and at least a portion of the piston body 131. The cylinder 120 may have the compression space P in which the refrigerant may be compressed by the piston 130. Also, a suction hole 133, through which the refrigerant may be introduced into the compression space P, may be defined in a front portion of the piston body 131, and a suction valve 135 that selectively opens the suction hole 133 may be disposed or provided on a front side of the suction hole 133. A coupling hole, to which a predetermined coupling member 135*a* may be coupled, may be defined in an approximately central portion of the suction valve 135.

A discharge cover 200 that defines a discharge space for the refrigerant discharged from the compression space P and a discharge valve assembly 161 and 163 coupled to the discharge cover 200 to selectively discharge the refrigerant compressed in the compression space P may be provided at a front side of the compression space P. The discharge cover 200 may include a plurality of covers (see reference numeral 210, 230, and 250 of FIG. 7). The discharge space may have a plurality of space parts or spaces defined by the plurality of covers 210, 230, and 250. The plurality of space parts may be disposed or provided in a front and rear direction to communicate with each other. This will be described hereinafter.

The discharge valve assembly 161 and 163 may include a discharge valve 161 which may be opened when the pressure of the compression space P is above a discharge pressure to introduce the refrigerant into the discharge space and a spring assembly 163 disposed or provided between the discharge valve 161 and the discharge cover 200 to provide elastic force in the axial direction. The spring assembly 163 may include a valve spring 163*a* and a spring support part or support 163*b* that supports the valve spring 163*a* to the discharge cover 200. For example, the valve spring 163*a* may include a plate spring.

The discharge valve 161 may be coupled to the valve spring 163*a*, and a rear portion or rear surface of the discharge valve 161 may be disposed to be supported on a front surface of the cylinder 120. When the discharge valve 161 is supported on the front surface of the cylinder 120, the compression space may be maintained in the sealed state. When the discharge valve 161 is spaced apart from the front surface of the cylinder 120, the compression space P may be opened to allow the refrigerant in the compression space P to be discharged.

The compression space P may be understood as a space defined between the suction valve 135 and the discharge valve 161. Also, the suction valve 135 may be disposed on or at one side of the compression space P, and the discharge valve 161 may be disposed on or at the other side of the compression space P, that is, an opposite side of the suction valve 135.

While the piston 130 linearly reciprocates within the cylinder 120, when the pressure of the compression space P is below the discharge pressure and a suction pressure, the suction valve 135 may be opened to suction the refrigerant into the compression space P. On the other hand, when the pressure of the compression space P is above the suction pressure, the suction valve 135 may compress the refrigerant of the compression space P in a state in which the suction valve 135 is closed.

When the pressure of the compression space P is above the discharge pressure, the valve spring 163*a* may be deformed forward to open the discharge valve 161. Here, the refrigerant may be discharged from the compression space P into the discharge space of the discharge cover 200. When the discharge of the refrigerant is completed, the valve spring 163*a* may provide restoring force to the discharge valve 161 to close the discharge valve 161.

The linear compressor 10 may further include a cover pipe 162*a* coupled to the discharge cover 200 to discharge the refrigerant flowing through the discharge space of the discharge cover 200. For example, the cover pipe 162*a* may be made of a metal material.

Also, the linear compressor 10 may further include a loop pipe 162*b* coupled to the cover pipe 162*a* to transfer the refrigerant flowing through the cover pipe 162*a* to the discharge pipe 105. The loop pipe 162*b* may have one or a first side or end coupled to the cover pipe 162*a* and the other or a second side or end coupled to the discharge pipe 105.

A cover coupling part or portion 162*c* coupled to the cover pipe 162*a* is disposed on the one side portion of the loop pipe 162*b*, and a discharge coupling part or portion 162*d* coupled to the discharge pipe 105 may be disposed or provided on the other side portion of the loop pipe 162*b*.

The loop pipe 162*b* may be made of a flexible material and have a relatively long length. Also, the loop pipe 162*b* may roundly extend from the cover pipe 162*a* along the inner circumferential surface of the shell 101 and be coupled to the discharge pipe 105. For example, the loop pipe 162*b* may have a wound shape.

The linear compressor 10 may further include a frame 110. The frame 110 is understood as a component for fixing the cylinder 120. For example, the cylinder 120 may be press-fitted into the frame 110.

The frame 110 may be disposed or provided to surround the cylinder 120. That is, the cylinder 120 may be disposed or provided to be accommodated into the frame 110. Also, the discharge cover 200 may be coupled to a front surface of the frame 110 using a coupling member.

The motor assembly 140 may include an outer stator 141 fixed to the frame 110 and disposed or provided to surround the cylinder 120, an inner stator 148 disposed or provided to be spaced inward from the outer stator 141, and the permanent magnet 146 disposed or provided in a space between the outer stator 141 and the inner stator 148.

The permanent magnet 146 may be linearly reciprocated by mutual electromagnetic force between the outer stator 141 and the inner stator 148. Also, the permanent magnet 146 may be provided as a single magnet having one polarity or by coupling a plurality of magnets having three polarities to each other.

The magnet frame 138 may be installed or provided on the permanent magnet 146. The magnet frame 138 may have an approximately cylindrical shape and be disposed or provided to be inserted into the space between the outer stator 141 and the inner stator 148.

Referring to the cross-sectional view of FIG. 4, the magnet frame 138 may be coupled to the piston flange part 132 to extend in an outer radial direction and then be bent forward. The permanent magnet 146 may be installed or provided on a front portion of the magnet frame 138. When the permanent magnet 146 reciprocates, the piston 130 may reciprocate together with the permanent magnet 146 in the axial direction.

The outer stator 141 may include coil winding bodies 141*b*, 141*c*, and 141*d* and a stator core 141*a*. The coil winding bodies 141*b*, 141*c*, and 141*d* may include a bobbin 141*b* and a coil 141*c* wound in a circumferential direction of the bobbin 141*b*. The coil winding bodies 141*b*, 141*c*, and 141*d* may further include a terminal part or portion 141*d* that guides a power line connected to the coil 141*c* so that the power line is led out or exposed to the outside of the outer stator 141.

The stator core 141*a* may include a plurality of core blocks in which a plurality of laminations are laminated in a circumferential direction. The plurality of core blocks may be disposed or provided to surround at least a portion of the coil winding bodies 141*b* and 141*c*.

A stator cover 149 may be disposed or provided on one or a first side of the outer stator 141. That is, the outer stator 141 may have one or a first side supported by the frame 110 and the other or a second side supported by the stator cover 149.

The linear compressor 10 may further include a cover coupling member 149*a* for coupling the stator cover 149 to the frame 110. The cover coupling member 149*a* may pass through the stator cover 149 to extend forward to the frame 110 and then be coupled to a first coupling hole (not shown) of the frame 110.

The inner stator 148 may be fixed to a circumference of the frame 110. Also, in the inner stator 148, the plurality of laminations may be laminated in the circumferential direction outside of the frame 110.

The linear compressor 10 may further include a support 137 that supports the piston 130. The support 137 may be coupled to a rear portion of the piston 130, and the muffler 150 may be disposed or provided to pass through the inside of the support 137. The piston flange part 132, the magnet frame 138, and the support 137 may be coupled to each other using a coupling member.

A balance weight 179 may be coupled to the support 137. A weight of the balance weight 179 may be determined based on a drive frequency range of the compressor body.

The linear compressor 10 may further include a rear cover 170 coupled to the stator cover 149 to extend backward and supported by the second support device 185. The rear cover 170 may include three support legs, and the three support legs may be coupled to a rear surface of the stator cover 149. A spacer 181 may be disposed or provided between the three support legs and the rear surface of the stator cover 149. A distance from the stator cover 149 to a rear end of the rear cover 170 may be determined by adjusting a thickness of the spacer 181. Also, the rear cover 170 may be spring-supported by the support 137.

The linear compressor 10 may further include an inflow guide part or guide 156 coupled to the rear cover 170 to guide an inflow of the refrigerant into the muffler 150. At least a portion of the inflow guide part 156 may be inserted into the suction muffler 150.

The linear compressor 10 may further include a plurality of resonant springs 176*a* and 176*b* which may be adjusted in natural frequency to allow the piston 130 to perform a resonant motion. The plurality of resonant springs 176*a* and 176*b* may include a first resonant spring 176*a* supported between the support 137 and the stator cover 149 and a second resonant spring 176*b* supported between the support 137 and the rear cover 170. The drive part that reciprocates within the linear compressor 10 may be stably moved by the action of the plurality of resonant springs 176*a* and 176*b* to reduce vibration or noise due to the movement of the drive part. The support 137 may include a first spring support part or support 137*a* coupled to the first resonant spring 176*a*.

The linear compressor 10 may include a plurality of sealing members or seals 127, 128, 129*a*, and 129*b* that increases a coupling force between the frame 110 and the peripheral parts around the frame 110. The plurality of sealing members 127, 128, 129*a*, and 129*b* may include a first sealing member 127 disposed or provided at a portion at which the frame 110 and the discharge cover 200 are coupled to each other. The first sealing member 127 may be disposed or provided on or in a second installation groove (not shown) of the frame 110.

The plurality of sealing members 127, 128, 129*a*, and 129*b* may further include a second sealing member 128 disposed or provided at a portion at which the frame 110 and the cylinder 120 are coupled to each other. The second sealing member 128 may be disposed on or in a first installation groove (not shown) of the frame 110.

The plurality of sealing members 127, 128, 129*a*, and 129*b* may further include a third sealing member 129*a* disposed or provided between the cylinder 120 and the frame 110. The third sealing member 129*a* may be disposed or provided on or in a cylinder groove defined in the rear portion of the cylinder 120.

The plurality of sealing members 127, 128, 129*a*, and 129*b* may further include a fourth sealing member 129*b* disposed or provided at a portion at which the frame 110 and the inner stator 148 are coupled to each other. The fourth sealing member 129*b* may be disposed or provided on or in a third installation groove (not shown) of the frame 110.

Each of the first to fourth sealing members 127, 128, 129*a*, and 129*b* may have a ring shape.

The linear compressor 10 may further include a first support device or support 165 coupled to a support coupling part or portion of the discharge cover 200 to support one side of the main body of the compressor 10. The first support device 165 may be disposed or provided adjacent to the second shell cover 103 to elastically support the main body of the compressor 10. The first support device 165 may include a first support spring 166. The first support spring 166 may be coupled to the spring coupling part 101*a*.

The linear compressor 10 may further include the second support device 185 coupled to the rear cover 170 to support the other side of the main body of the compressor 10. The second support device 185 may be coupled to the first shell cover 102 to elastically support the main body of the compressor 10. The second support device 185 may include a second support spring 186. The second support spring 186 may be coupled to the cover support part 102*a*.

Figure 5:
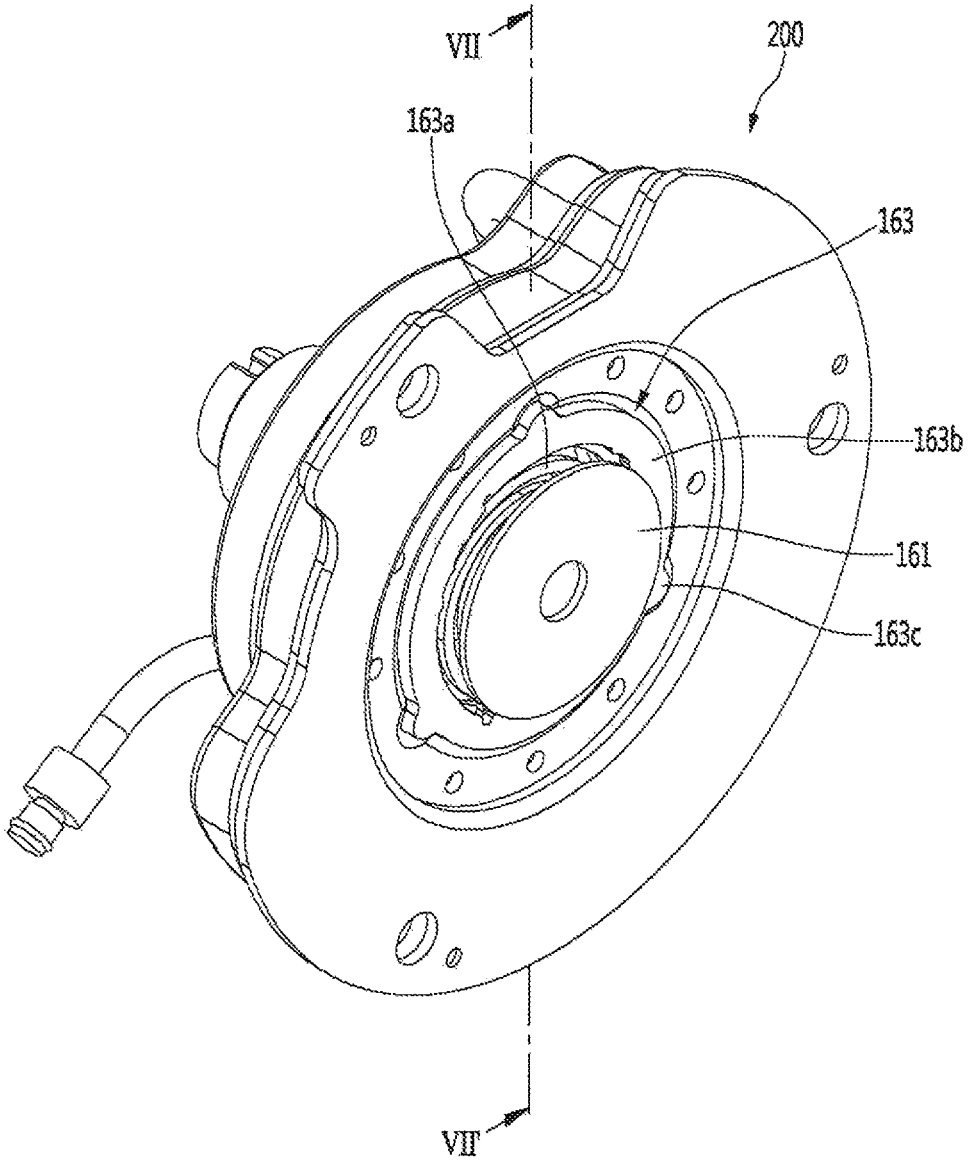
FIG. 5 is a perspective view illustrating a coupled configuration of a discharge cover and a discharge valve assembly according to an embodiment.
Figure 6:
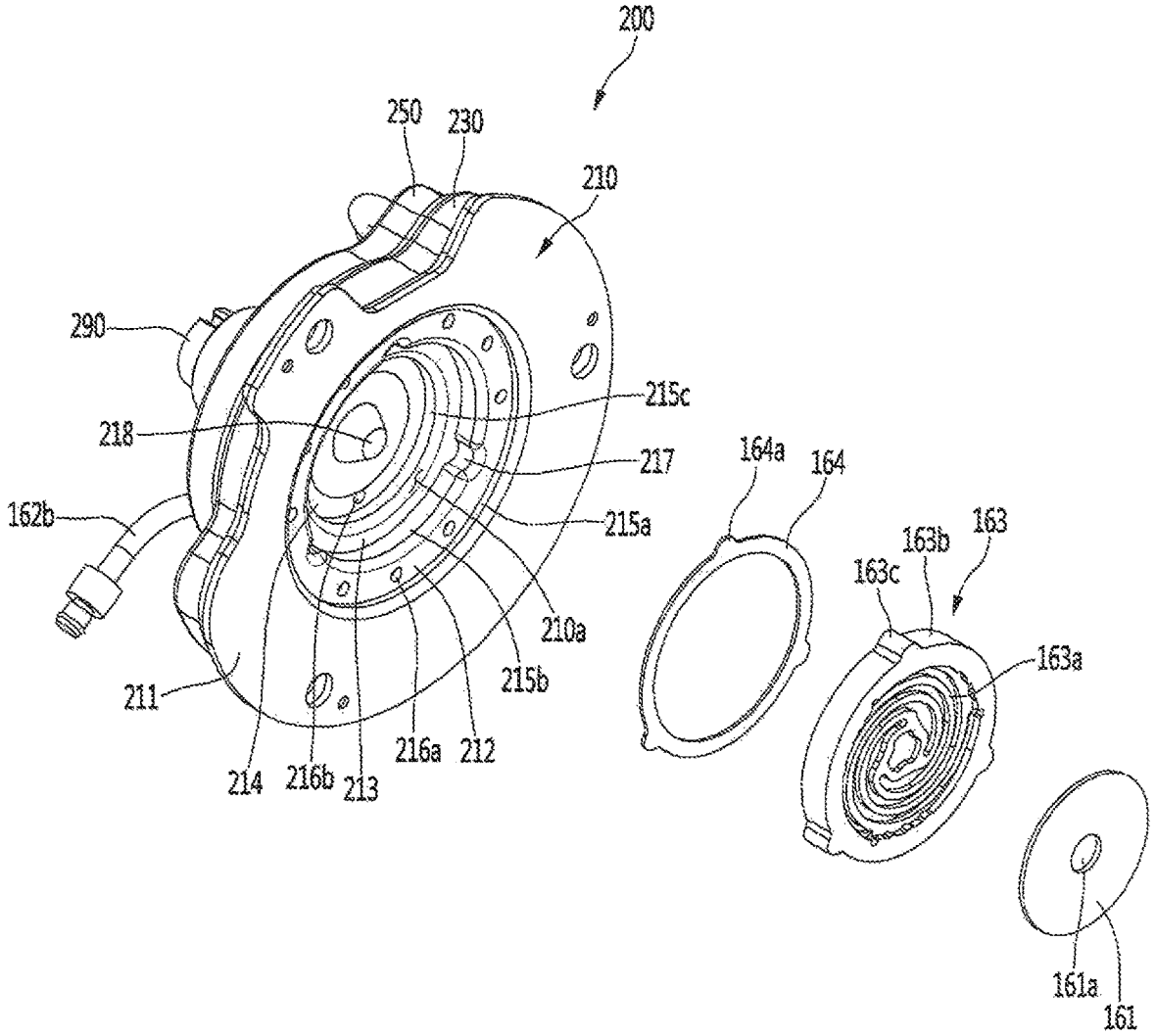
FIG. 6 is an exploded perspective view illustrating the coupled configuration of the discharge cover and the discharge valve assembly according to an embodiment.
Figure 7:
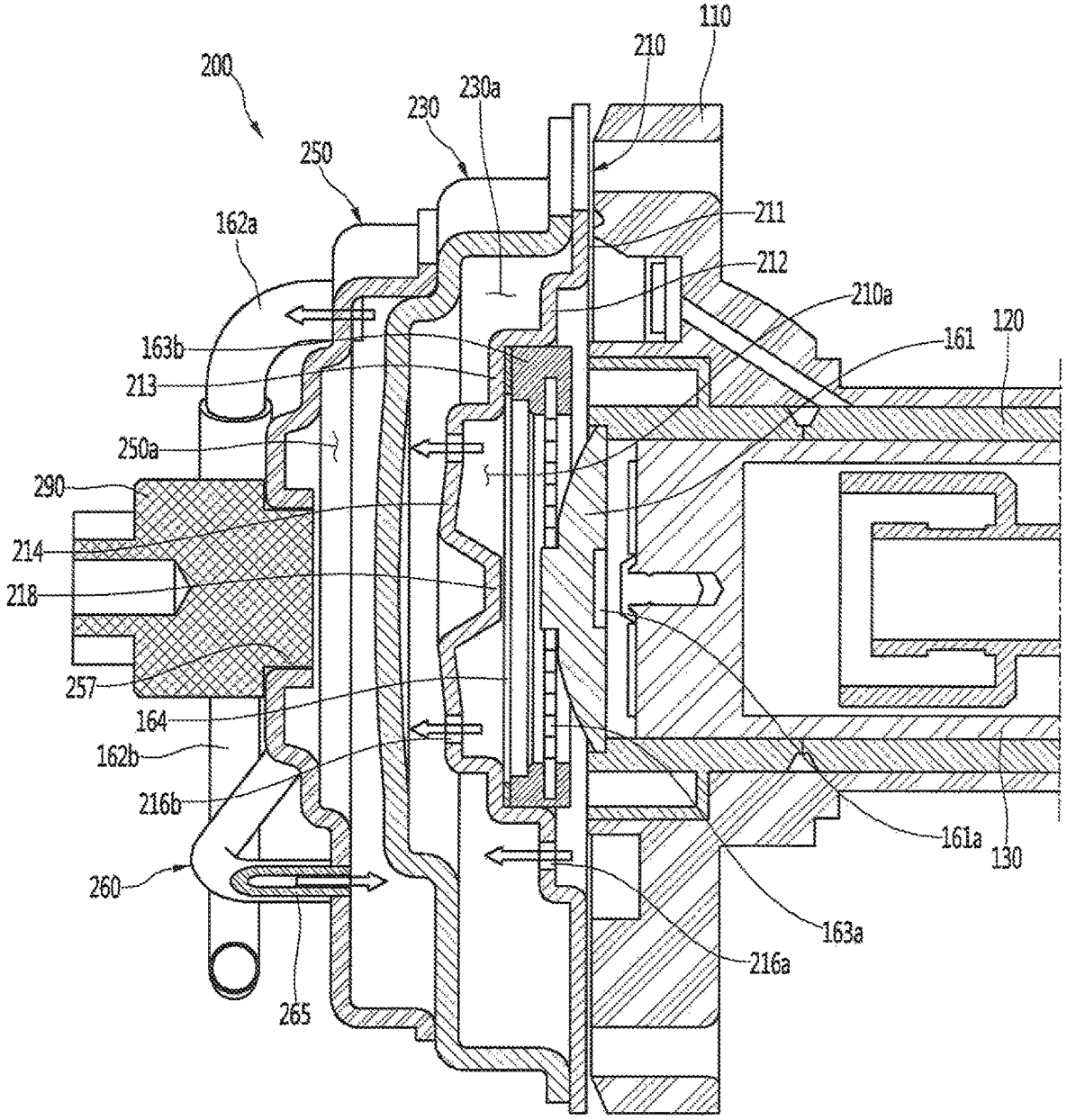
FIG. 7 is a cross-sectional view, taken along line VII-VII' of FIG. 5.

FIG. 5 is a perspective view illustrating a coupled configuration of the discharge cover and the discharge valve assembly according to an embodiment. FIG. 6 is an exploded perspective view illustrating the coupled configuration of the discharge cover and the discharge valve assembly according to an embodiment. FIG. 7 is a cross-sectional view taken along line VI-VI' of FIG. 5.

Referring to FIGS. 5 to 7, the linear compressor 10 according to an embodiment may include the discharge valve assembly 161 and 163 and the discharge cover 200 coupled to the discharge valve assembly 161 and 163 to define the discharge space of the refrigerant discharged from the compression space P of the cylinder 120. For example, the discharge valve assembly 161 and 163 may be press-fitted and coupled to the discharge cover 200.

The discharge valve assembly 161 and 163 may include the discharge valve 161 installed or provided on a front end of the cylinder 120 to selectively open the compression space P and the spring assembly 163 coupled to a front side of the discharge valve 161. When the discharge valve 161 is closely attached to the front end of the cylinder 120, the compression space P may be closed. When the discharge valve 161 moves forward and then is spaced apart from the cylinder 120, the refrigerant compressed in the compression space P may be discharged.

The discharge valve 161 may be made of a plastic material. For example, the discharge valve 161 may be made of a polyether ether ketone (PEEK) material. The PEEK material may have superior heat-resistance, impact strength, and wear resistance.

The discharge valve 161 may have an avoid groove 161*a* that avoids the coupling member 135*a* of the suction valve 135. The avoid groove 161*a* may be recessed forward from a rear surface of the discharge valve 161.

The spring assembly 163 may include the valve spring 163*a* coupled to the discharge valve 161. For example, the valve spring 163*a* may include a plate spring having a plurality of cutoff grooves. A coupling hole, to which the discharge valve 161 may be coupled, may be defined in an approximately central portion of the valve spring 163*a*.

The spring assembly 163 may include the spring support part 163*b* coupled to the valve spring 163*a*. The spring support part 163*b* may be understood as a component coupled to the discharge cover 200 to support the valve spring 163*a* to the discharge cover 200. For example, the spring support part 163*b* may be press-fitted and coupled to the discharge cover 200. Also, the spring support part 163*b* may be integrally injection-molded to the valve spring 163*a* through an injection-molding process, for example.

The discharge cover 200 may further include a gasket 164 installed or provided on or at a front side of the spring assembly 163. The gasket 164 may allow the spring assembly 163 to be closely attached to the discharge cover 200 to prevent the refrigerant from leaking through a space between the spring assembly 163 and the discharge cover 200.

The spring support part 163*b* may include a first protrusion 163*c* that prevents the discharge valve 161 and the spring assembly 163 from rotating. A plurality of the first protrusion 163*c* may be provided on an outer circumferential surface of the spring support part 163*b*.

The gasket 164 may further include a second protrusion 164*a* corresponding to a position and shape of the first protrusion 163*c*. That is, a plurality of second protrusions 164*a* may be disposed or provided on an outer circumferential surface of the gasket 164.

Also, the discharge cover 200 may further include a recess part or recess 217 coupled to the outer circumferential surface of the spring assembly 163 or the outer circumferential surface of the gasket 164. The first protrusion 163*c* and the second protrusion 164*a* may be coupled to the recess part 217. The recess part 217 may be defined in the first cover 210 and a plurality of the recess part 217 may be provided to correspond to the plurality of first and second protrusions 163*c* and 164*a*.

A process of coupling the spring assembly 163 to the discharge cover 200 will be described hereinafter. The gasket 164 may be seated on a third part or portion 213 of the discharge cover 200. The second protrusion 164*a* of the gasket 164 may be inserted into the recess part 217.

The spring assembly 163 may be press-fitted into the discharge cover 200. When the gasket 164 is pressed, a front surface of the spring assembly 163 may be coupled to the third part 213, and the first protrusion 163*c* may be disposed or provided in the recess part 217. In this process, the spring support part 163*b* may be deformed.

As the spring assembly 163 is press-fitted into the discharge cover 200, the spring assembly 163 and the discharge valve 161 may be stably supported by the discharge cover 200. Also, as the first and second protrusions 163*c* and 164*a* may be coupled to the recess part 217, rotation of the spring assembly 163 and the discharge valve 161 may be prevented.

The discharge cover 200 may include a first cover 210 that defines a first space part or space in which the discharge valve 161 and the spring assembly 163 may be disposed or provided. The first cover 210 may be stepped forward.

The first cover 210 may include a first part or portion 211 that defines a rear surface of the first cover 210 and provides a coupling surface to which the frame 110 may be coupled and a first stepped part or step 215*a* that extends forward from the first part 211. The first cover 210 may have a shape which may be recessed forward from the first part 211 by the first stepped part 215*a*.

The first cover 210 may further include a second part or portion 212 that extends by a first preset or predetermined length inward from the first stepped part 215*a* in a radial direction. The first cover 210 may further include a second stepped part or step 215*b* that extends forward from the second part 212. The first cover 210 may have a shape which may be recessed forward from the second part 212 by the second stepped part 215*b*. The recess part 217 may be defined in an outer circumferential surface of the second stepped part 215*b*.

The first cover 210 may further include a third part or portion 213 extending by a second preset or predetermined length inward from the second stepped part 215*b* in the radial direction. The third part 213 may have a seating surface on which the spring assembly 163 may be seated.

The gasket 164 may be disposed or provided on the third part 213, and the spring assembly 163 may be coupled to a rear side of the third part 213. Thus, the third part 213 may be coupled to a front surface of the spring assembly 163. Also, the outer circumferential surface of the spring assembly 163 may be press-fitted into the second stepped part 215*b*.

The first cover 210 may further include a third stepped part or step 215*c* that extends forward from the third part 213. The first cover 210 may have a shape which may be recessed forward from the third part 213 by the third stepped part 215*c*.

The first cover 210 may further include a fourth part or portion 214 that extends inward from the third stepped part 215 in the radial direction. A stopper 218 that protrudes backward may be disposed or provided on an approximately central portion of the fourth part 214. When the linear compressor 10 abnormally operates, particularly, when an opened degree of the discharge valve 161 is greater than a preset or predetermined level, the stopper 218 may protect the discharge valve 161 or the valve spring 163*a*.

The abnormal operation may be understood as a momentary abnormal behavior of the discharge valve 161 due to a variation in flow rate or pressure within the compressor. The stopper 218 may interfere with the discharge valve 161 or the valve spring 163*a* to prevent the discharge valve 161 or the valve spring 163*a* from further moving forward.

Discharge holes 216*a* and 216*b*, through which the refrigerant flowing through the first space part 210*a* may be transferred to the second cover 230, may be defined in the first cover 210. The discharge holes 216*a* and 216*b* may include a first discharge hole 216*a* defined in the second part 212. A plurality of the first discharge hole 216*a* may be provided, and the plurality of first discharge holes 216*a* may be disposed or provided to be spaced apart from each other along a circumference of the second part 212.

As the discharge valve 161 is opened, the refrigerant, which does not pass through the spring assembly 163, of the refrigerant flowing into the first space part 210*a*, that is, the refrigerant existing in or at an upstream side of the spring assembly 163 may be discharged to the outside of the first cover 210 through the first discharge hole 216*a*. Also, the refrigerant discharged through the first discharge hole 216*a* may be introduced into the second space part 230*a* of the second cover 230.

The discharge holes 216*a* and 216*b* may include a second discharge hole 216*b* defined in the fourth part 214. A plurality of the second discharge hole 216*b* may be provided, and the plurality of second discharge holes 216*b* may be disposed or provided to be spaced apart from each other along a circumference of the fourth part 214.

As the discharge valve 161 is opened, the refrigerant, which passes through the spring assembly 163, of the refrigerant flowing into the first space part 210*a*, that is, the refrigerant existing in or at a downstream side of the spring assembly 163 may be discharged to the outside of the first cover 210 through the second discharge hole 216*b*. Also, the refrigerant discharged through the second discharge hole 216*b* may be introduced into the second space part 230*a* of the second cover 230.

The number of second discharge holes 216*b* may be less than the number of first discharge holes 216*a*. Thus, in the refrigerant passing through discharge valve 161, a relatively large amount of refrigerant may pass through the first discharge holes 216*a*, and a relatively small amount of refrigerant may pass through the second discharge holes 216*b*.

Hereinafter, components of the discharge cover 200 will be described with reference with the accompanying drawings.

Figure 8:
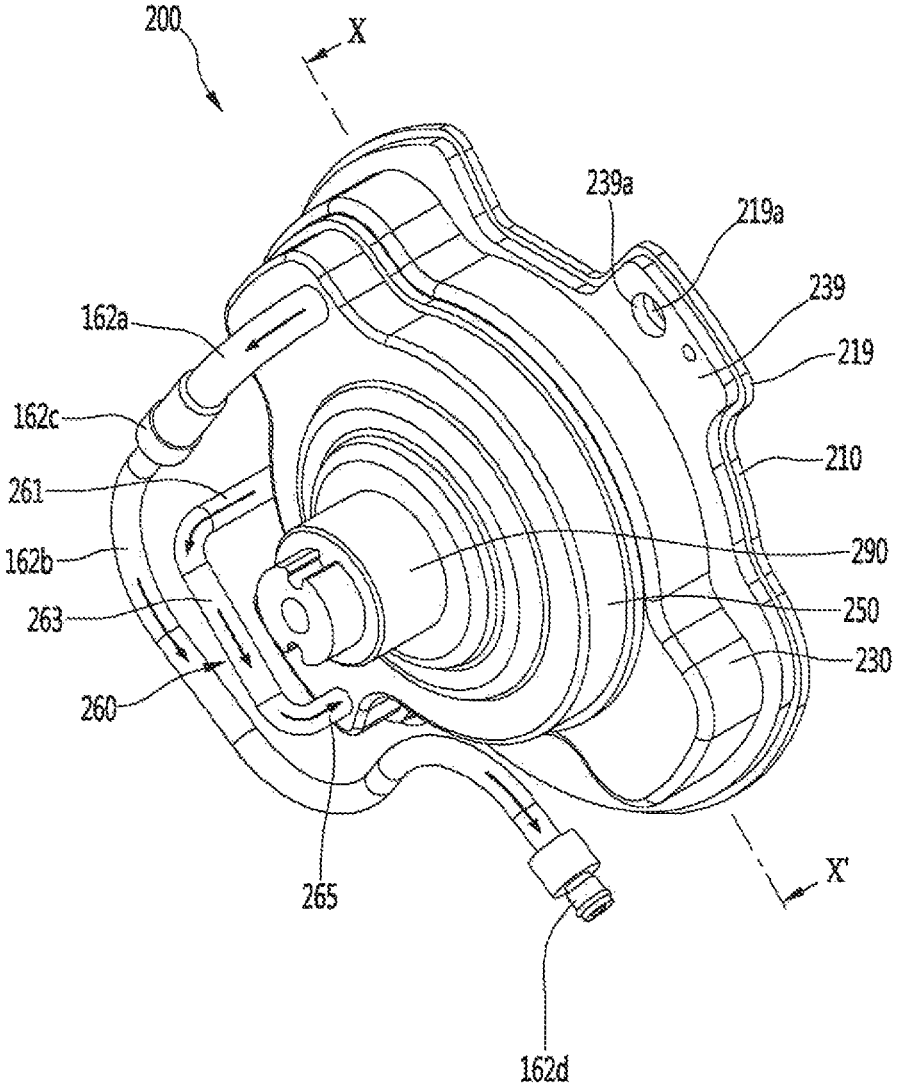
FIG. 8 is a perspective view of the discharge cover according to an embodiment.
Figure 9:
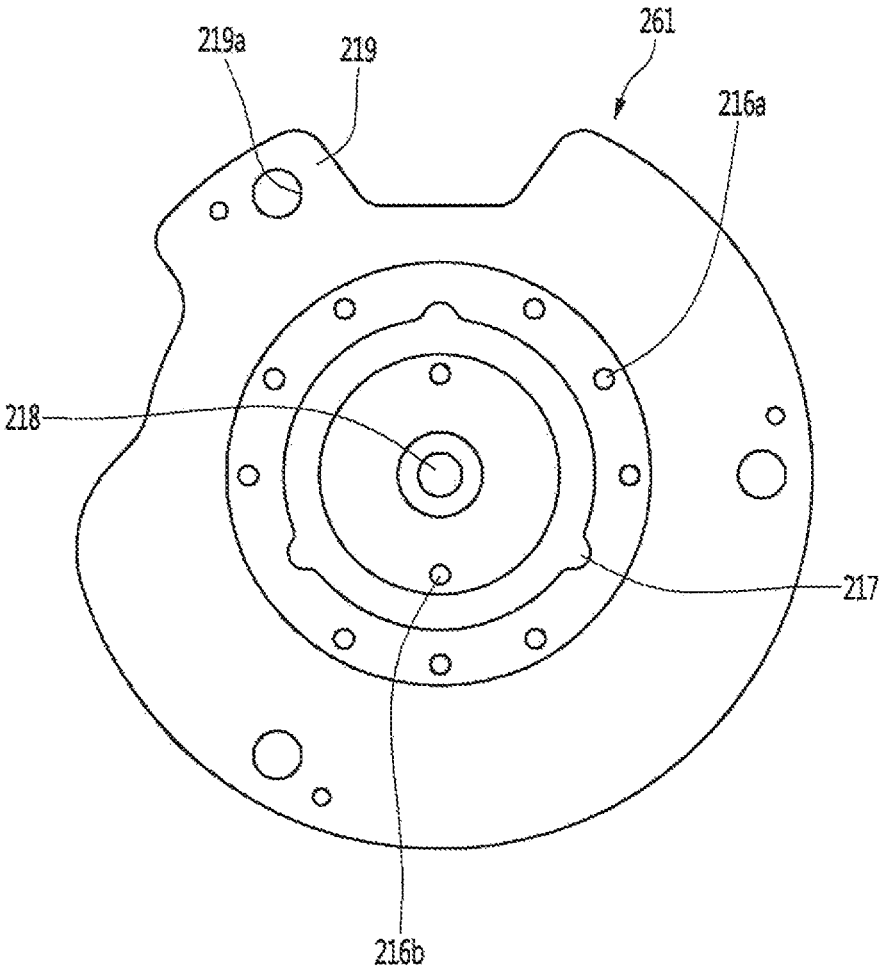
FIG. 9 is a view illustrating an internal configuration of a first cover of the discharge cover according to an embodiment.
Figure 10:
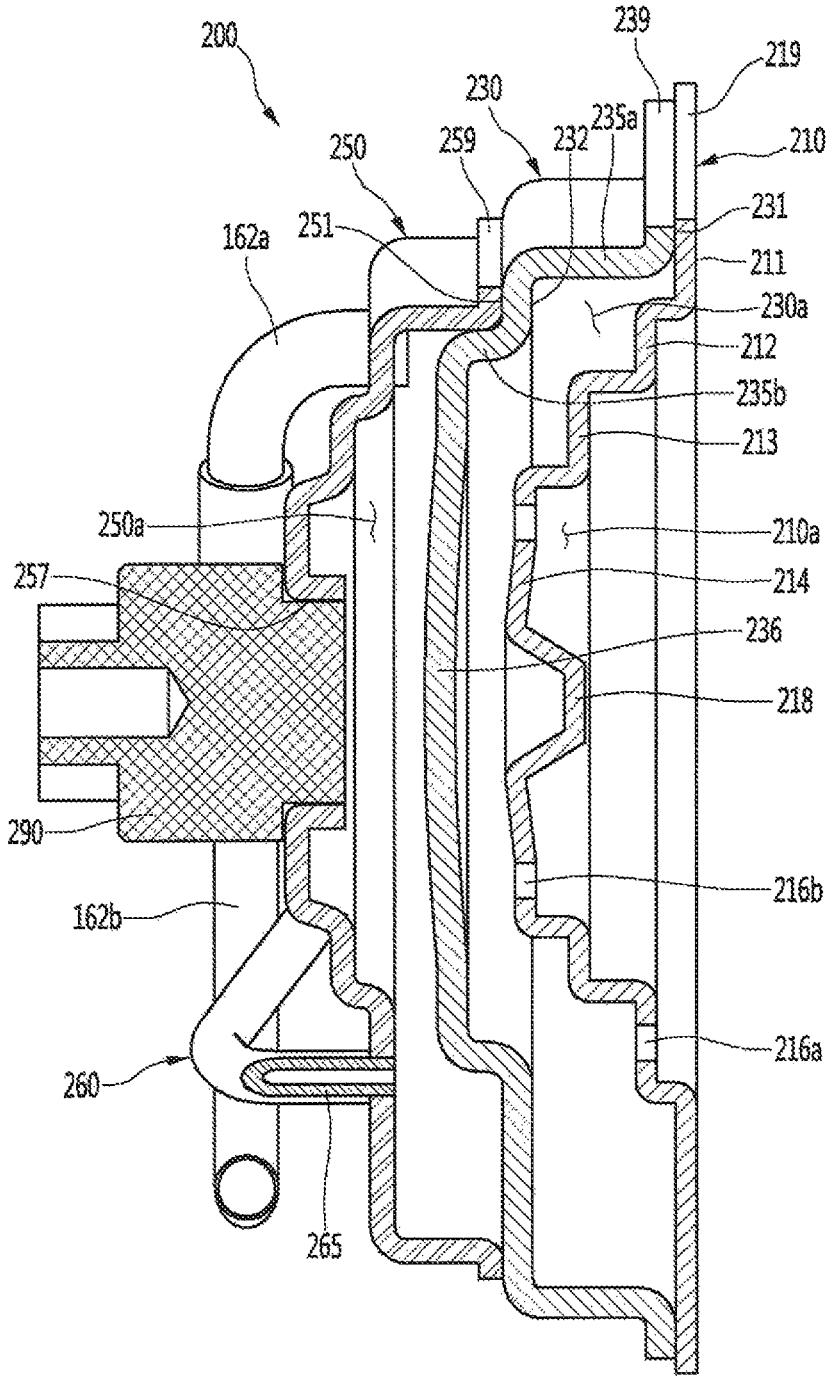
FIG. 10 is a cross-sectional view, taken along line X-X' of FIG. 8.
Figure 11:
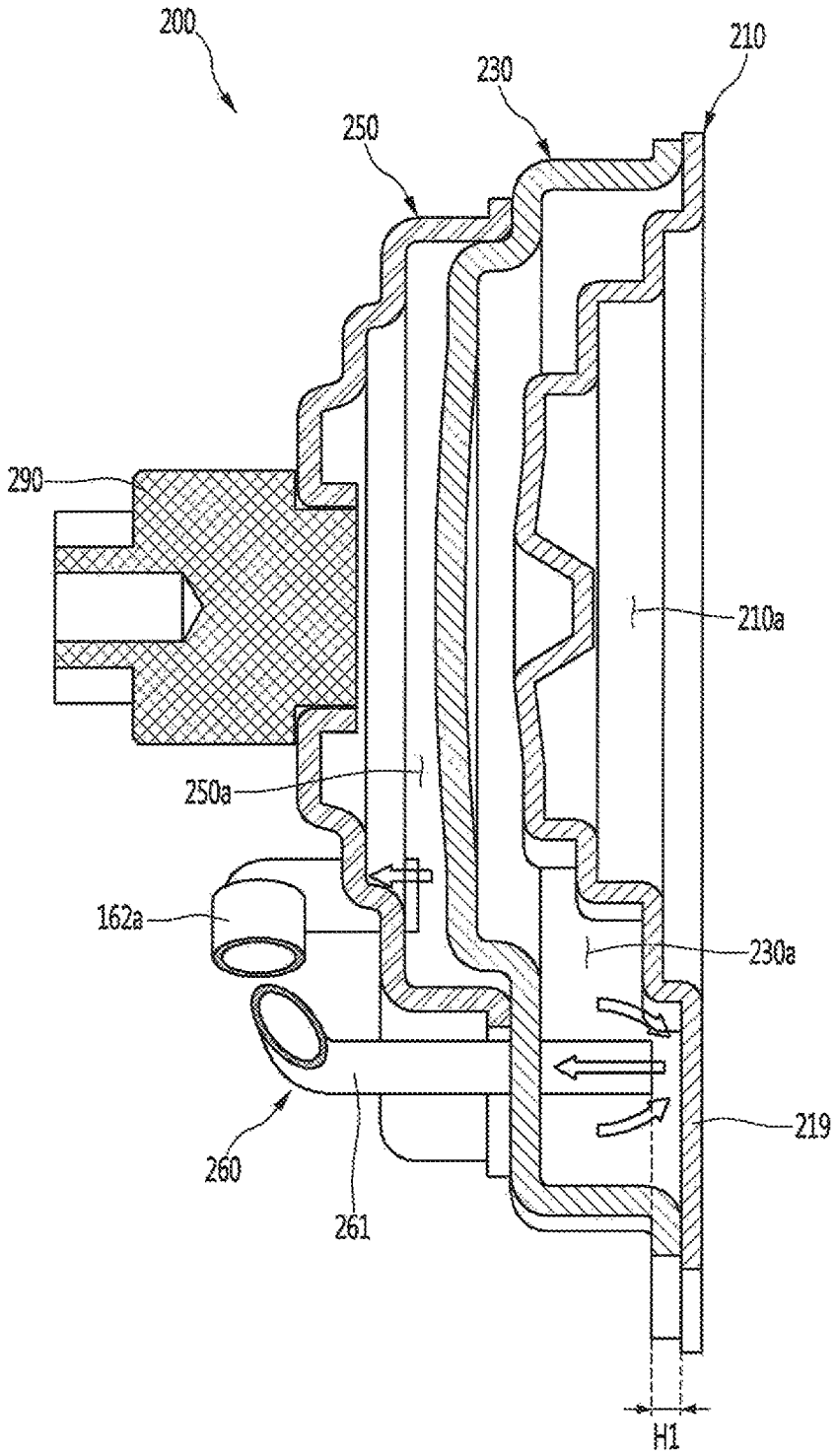
FIG. 11 is a cross-sectional view illustrating a state in which a connection pipe is coupled to a second cover according to an embodiment.

FIG. 8 is a perspective view of the discharge cover according to an embodiment. FIG. 9 is a view illustrating an internal configuration of the first cover of the discharge cover according to an embodiment. FIG. 10 is a cross-sectional view taken along line X-X' of FIG. 8. FIG. 11 is a cross-sectional view of a state in which the connection pipe is coupled to the second cover according to an embodiment.

Referring to FIGS. 8 to 11, the discharge cover 200 according to an embodiment may include the plurality of covers 210, 230, and 250 defining a plurality of discharge spaces or a plurality of discharge chambers. The plurality of covers 210, 230, and 250 may be coupled to the frame 110 and stacked forward with respect to the frame 110.

The plurality of covers 210, 230, and 250 may include the first cover 210 having the first part 211 coupled to the front surface of the frame 110 and the second cover 230 coupled to a front side of the first cover 210. The first and second covers 210 and 230 may be stacked in the axial direction. Also, the discharge cover 200 may include a third cover 250 coupled to a front side of the second cover 230. The second and third covers 230 and 250 may be stacked in the axial direction. As a result, the first to third covers 210, 230, and 250 may be stacked in the axial direction.

The plurality of covers 210, 230, and 250 may include cover holes 219*a* and 239*a*, to which a predetermined coupling member may be coupled. The cover holes 219*a* and 239*a* may include a first cover hole 219*a* defined in the first cover 210 and a second cover hole 239*a* defined in the second cover 230.

The first cover hole 219*a* may be defined in a first cover flange 219 disposed or provided an edge of the first cover 210, and the second cover hole 239*a* may be defined in a second cover flange 239 disposed or provided on or at an edge of the second cover 230. A plurality of each of the first cover holes 219*a* and 239*a* may be provided. Also, a rear surface of the first cover flange 219 may define the first part 211.

The coupling member may pass through the first and second cover holes 219*a* and 239*a* and then be coupled to a coupling hole (not shown) of the frame 110. Thus, the first cover flange 219 and the second cover flange 239 may be coupled to each other, and the first and second covers 210 and 230 may be stably supported by the frame 110.

As described above, the first cover 210 may have a stepped structure. Also, the first space part 210*a*, through which the refrigerant discharged through the discharge valve 161 may flow, may be defined within the first cover 210.

The second cover 230 may be coupled to an outer surface of the first cover 210. As described above, as the first and second cover flanges 219 and 239 are coupled to each other, the first and second covers 210 and 230 may be coupled to each other. Also, the second space part 230*a*, through which the refrigerant may flow, may be defined between the outer surface of the first cover 210 and an inner surface of the second cover 230. The refrigerant discharged from the first cover 210 through the first and second discharge holes 216*a* and 216*b* of the first cover 210 may be introduced into the second space part 230*a*.

The second cover 230 may have a structure which may be stepped forward. The second cover 230 may include the fourth part 231 coupled to the outer surface of the first cover 210. The fourth part 231 may be disposed or provided on a rear surface of the second cover flange 239.

The second cover 230 may further include a fourth stepped part or step 235*a* that extends forward from the fourth part 231. The second cover 230 may have a shape which may be recessed forward from the fourth part 231 by the fourth stepped part 235*a*. Also, the second cover 230 may include a fifth part or portion 232 that extends by a third preset or predetermined length inward from the fourth stepped part 235*a* in the radial direction.

The second cover 230 may include a fifth stepped part or step 235*b* that extends forward from the fifth part 232 and a sixth part or portion 233 that extends inward from the fifth stepped part 235*b* in the radial direction. The second cover 230 may have a shape which may be recessed forward from the fifth part 232 by the fifth stepped part 235*b*.

The third cover 250 may be coupled to the outer surface of the second cover 230. The third cover 250 may be coupled to the fifth part 232 or the fifth stepped part 235*b* of the second cover 230. For example, the fifth part 232 and the fifth stepped part 235*b* may be coupled to an inner surface of the third cover 250.

A third space part or space 250*a*, through which the refrigerant may flow, may be defined between the outer surface of the second cover 230 and an inner surface of the third cover 250. The third space part 250*a* may be understood as a space between the sixth part 233 of the second cover 230 and the inner surface of the third cover 250.

A volume ratio of the first to third space parts 210*a*, 230*a*, and 250*a* may be determined or set to a preset or predetermined ratio. The second space part 230*a* may have a volume greater than a volume of the first space part 210*a*, and the third space part 250*a* may have a volume less than the volume of the second space part 230*a*. Thus, the refrigerant may flow from the first space part 210*a* to the second space part 230*a* having the relatively large volume to reduce pulsation and noise. Also, the refrigerant may flow from the second space part 230*a* to the third space part 250*a* having the relatively small volume to secure a flow rate of the refrigerant.

For example, the first and third space parts 210*a* and 250*a* may have the same volume, and the second space part 230*a* may have a volume greater than the volume of each of the first and third space parts 210*a* and 250*a*. More particularly, the first, second, and third space parts 210*a*, 230*a*, and 250*a* may have a volume ration of about 1:2.5:1.

The third cover 250 may include a third cover flange 259 coupled to the fifth part 232 of the second cover 230. A seventh part or portion 251 coupled to the fifth part 232 may be defined in a rear surface of the third cover flange 259. The third cover 250 may have a stepped structure. For example, the third cover 250 may include a stepped part or step that extends forward from the seventh part 251 and a part or portion that extends inward from the stepped part in the radial direction. A plurality of each of the stepped part and the part may be provided, and the plurality of stepped parts and the plurality of parts may alternately extend. As the shape is clearly shown in the drawings, separate reference numeral have not been given for description.

A coupling hole 257, to which the support coupling part 290 may be coupled, may be defined in an approximately central portion of the third cover 250. The support coupling part 290 may be a component that supports the discharge cover 200 to the first support device 165, made of a metal material, and coupled to the first support device 165 by a predetermined coupling member.

That is, the support coupling part 290 may have one or a first side portion coupled to the coupling hole 257 and the other or a second side portion coupled to the first support device 165. As the support coupling part 290 may be inserted into the third cover 250 through the coupling hole 257, the support coupling part 290 may be stably coupled to the discharge cover 200. Due to the above-described structure, vibration generated from the discharge cover 200 may be transmitted to the first support device 165 through the support coupling part 290. Also, vibration transmitted to the first support device 165 may be dispersed to the shell 101 via the first support spring 166 and the spring coupling part 101*a*. As a result, vibration of the linear compressor 10 may be reduced.

The discharge cover 200 may further include the connection pipe 260 through which the refrigerant within the second space part 230*a* may be transferred to the third space part 250*a* of the third cover 250. The connection pipe 260 may be coupled to the second cover 230 to extend to the outside of the second cover 230 and then be bent at least one time and coupled to the third cover 250.

The connection pipe 260 may include a first pipe 261 coupled to the second cover 230 to extend in a first direction, a second pipe 263 bent from the first pipe 261 to extend in a second direction, and a third pipe 265 bent from the second pipe 263 to extend in a third direction and then coupled to the third cover 250.

For example, the first direction may be understood as a direction which extends away from the second cover 230, the second direction may be understood as a direction which extends approximately perpendicular to the first direction, and the third direction may be understood as a direction which extends approximately perpendicular to the second direction. Also, the third direction may be understood as a direction which is directed to the third cover 250.

The connection pipe 260 may have a shape which is bent several times in a "⊏" shape by the first to third pipes 261, 263, and 265. As the connection pipe 260 is provided in the discharge cover 200, the discharge passage for the refrigerant may be elongated, and thus, pulsation of the refrigerant may be reduced.

The first pipe 261 may be coupled to the second cover 230 to extend toward the second space part 230*a* of the second cover 230. Also, an end of the first pipe 261 may be spaced a preset or predetermined distance H from the outer surface of the first cover 210, more particularly, the first cover flange 219.

The preset distance H may be determined as a value which corresponds to a height of the first stepped part 215*a* from the first cover flange 219 of the first cover 210. That is, the end of the first pipe 261 may be disposed at a height corresponding to the second part 212 in which the first discharge hole 216*a* is defined. The "height" may be understood as a forward distance using the first cover flange 219 as a reference point.

For example, the preset distance H1 may range from about 1 mm to 2 mm. When the preset distance H1 is less than about 1 mm or greater than about 2 mm, pressure loss of the refrigerant may occur (see FIG. 12).

When the end of the first pipe 261 is disposed too close to the first cover 210, that is, when a distance between the end of the first pipe 261 and the first cover 210 is too short, flow resistance of the refrigerant within the second space part 230*a* may be too high to cause the pressure loss. Also, when the distance between the end of the first pipe 261 and the first cover 210 is too long, a distance between the end of the first pipe 261 and the first discharge hole 216*a* may be too long to cause the pressure loss. Thus, in the current embodiment, a position of the first pipe 261 is proposed.

Also, the third pipe 265 may be coupled to the third cover 250. The refrigerant introduced from the first space part 210*a* of the first cover 210 to the second space part 230*a* of the second cover 230 through the first discharge hole 216*a* may be discharged to the outside of the second cover 230 while flowing through the first pipe 261.

The refrigerant within the first pipe 261 may flow to the outer surface of the third cover 250 while flowing through the second pipe 263 and then be introduced into the third space part 250*a* of the third cover 250 through the third pipe 265. Also, the refrigerant within the third space part 250*a* flows to the cover pipe 162*a* coupled to the third cover 250. The cover pipe 162*a* may extend a preset or predetermined length from the third cover 250 to the third space part 250*a*.

As described above, as the connection pipe 260 that extends to the outside of the second cover 230 and is coupled to the outer surface of the third cover 250 is provided, the discharge passage for the refrigerant may be elongated, and thus, pulsation of the refrigerant may be reduced. The refrigerant flowing through the cover pipe 162*a* may flow through the loop pipe 162*b* and then be discharged to the outside of the linear compressor 10 through the discharge pipe 105 connected to the loop pipe 162*b*.

Figure 12:
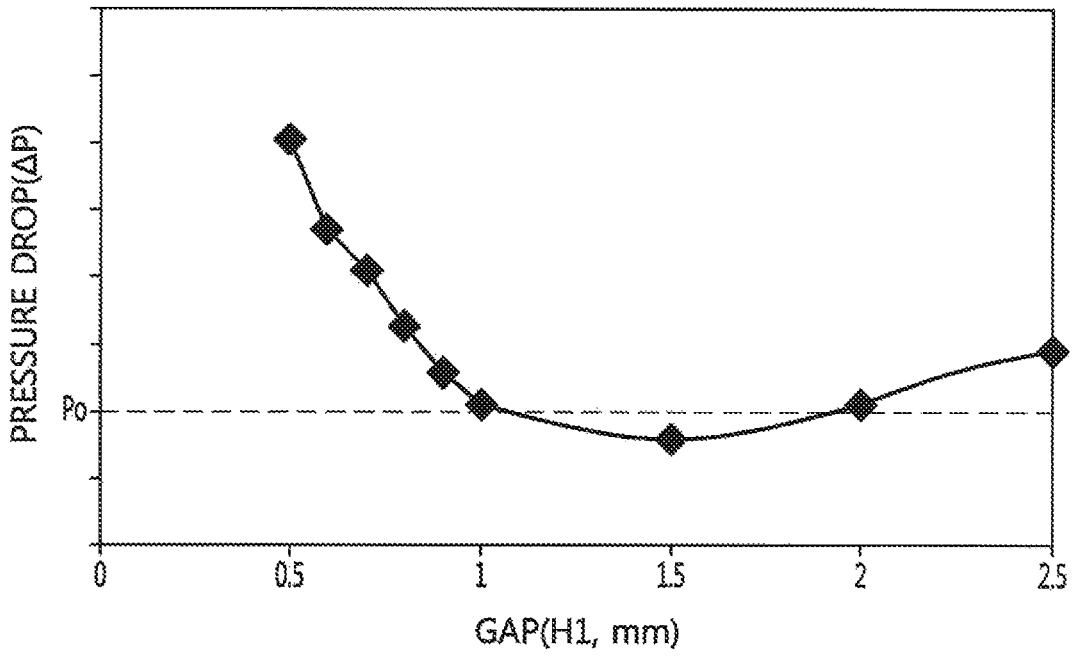
FIG. 12 is a test graph illustrating pressure drop depending on a variation in distance H1 between the connection pipe and an outer surface of the first cover according to an embodiment.
Figure 13:
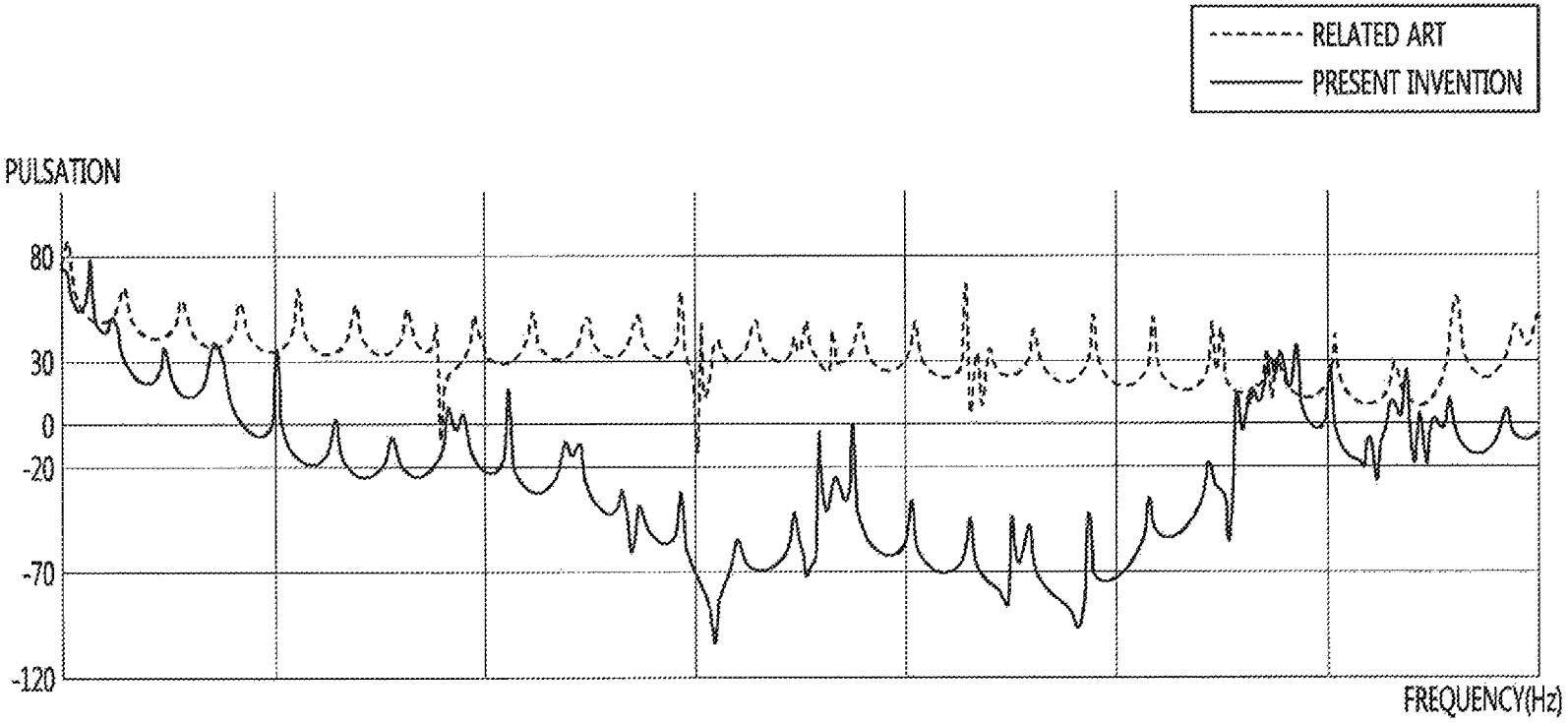
FIG. 13 is an experimental graph illustrating a state in which pulsation is reduced in comparison to the related art in a case of a stack-type discharge cover structure according to an embodiment.
Figure 14:
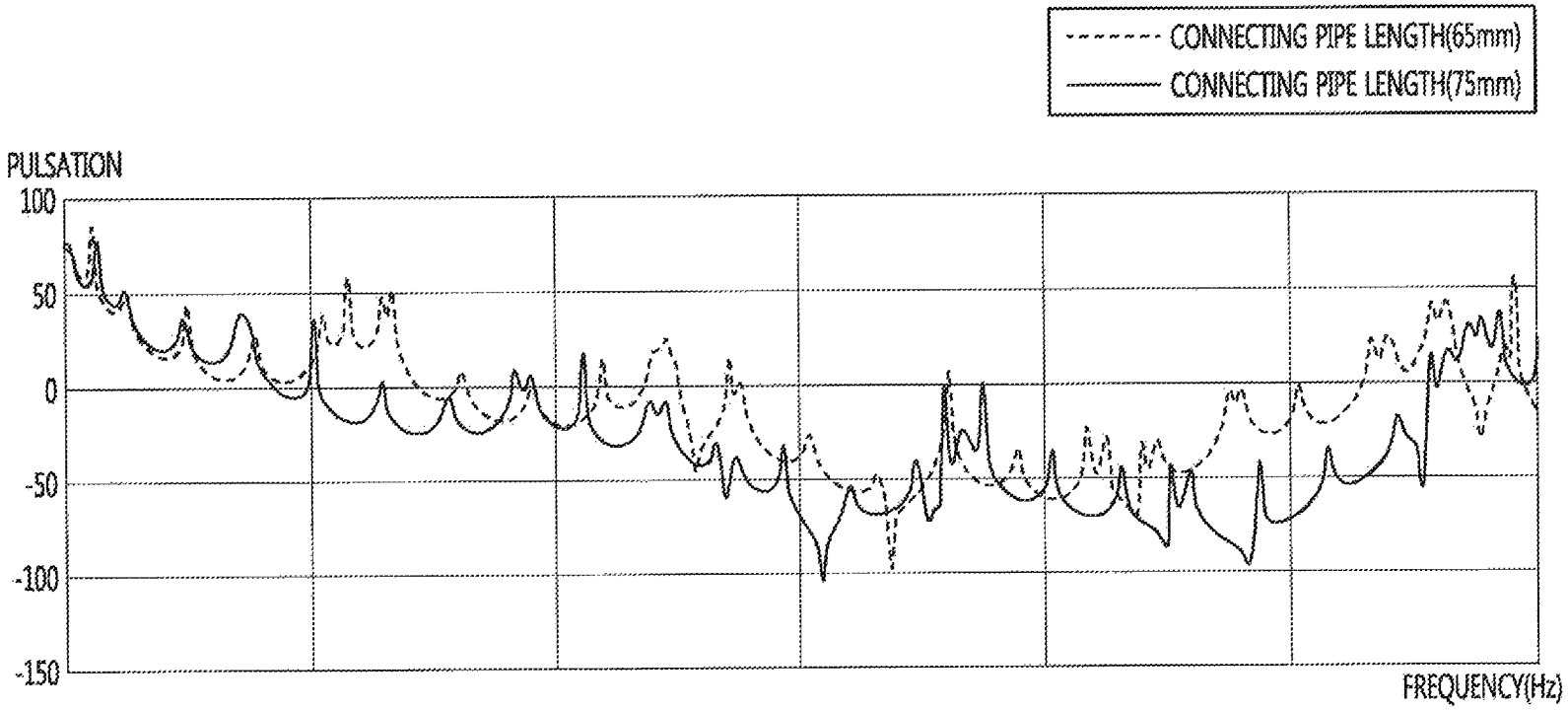
FIG. 14 is an experimental graph illustrating a state in which the pulsation varies depending on a length of the connection pipe according to an embodiment.

FIG. 12 is a test graph illustrating pressure drop depending on a variation in distance H1 between the connection pipe and the outer surface of the first cover according to an embodiment. FIG. 13 is an experimental graph illustrating a state in which pulsation is reduced in comparison to the related art in a case of the stack-type discharge cover structure according to an embodiment. FIG. 14 is an experimental graph illustrating a state in which the pulsation varies depending on a length of the connection pipe according to an embodiment.

Referring to FIG. 12, it is seen that the pressure drop of the refrigerant varies depending on a variation in the preset distance (H1, a gap). In the graph of FIG. 12, the horizontal axis represents the preset distance H1, and the vertical axis represents pressure drop (ΔP) of the refrigerant discharged from the discharge cover 200.

When the present distance H1 is less than about 1 mm, the pressure drop of the refrigerant is relatively high. To realize a desired performance of the linear compressor 10, when the preset pressure drop is a preset drop (ΔPo), if the preset distance H1 is less than about 1 mm, the pressure drop is measured to a value greater than the preset drop. However, the more the preset distance H1 approaches about 1 mm, the more the pressure drop is reduced.

Also, when the preset distance H1 is above about 1 mm, the pressure drop is less than the preset drop (ΔPo). A section in which the pressure drop is less than the preset drop (ΔPo), it is observed that the preset distance H1 ranges from about 1 mm to about 2 mm. Also, the preset distance H1 at which the lowest pressure drop occurs may be about 1.5 mm. Thus, in the current embodiment, the preset distance H1 may range from about 1 mm to about 2 mm, for example, about 1.5 mm.

Referring to FIG. 13, it is seen that the pulsation varies depending on a variation in frequency (Hz) of the refrigerant discharged from the discharge cover 200. The frequency (Hz) may be understood as a loudness frequency which is obtained from the discharged refrigerant, but not an input frequency (about 80 Hz to about 110 Hz) of the linear compressor 10. Also, the pulsation may be understood as a relative value which is expressed according to a predetermined reference.

In the graph of FIG. 13, a solid line shows results due to the structure of the discharge cover 200 according to an embodiment, and a dotted line shows results due to the structure of the discharge cover according to the related art, that is, the Prior Art Document 2.

As illustrated in FIG. 13, in the whole range of frequency, it is seen that the pulsation due to the discharge cover 200 according to an embodiment is less than that due to the discharge cover according to the related art. This shows that the pulsation from the discharge cover 200 according to an embodiment is reduced.

Referring to FIG. 14, it is seen that the pulsation measured depending on a length of the connection pipe 260 varies. Like FIG. 13, the frequency (Hz) displayed on the horizontal axis of the graph may be understood as a loudness frequency. Also, the pulsation may be understood as a relative value that is expressed according to the predetermined reference.

In the graph of FIG. 14, a solid line shows a variation in pulsation depending on a variation in frequency when a length of the connection pipe 260 according to an embodiment, that is, a sum of lengths of the first to third pipes 261, 263, and 265 ranges from about 70 mm to about 80 mm, for example, about 75 mm, and a dotted line shows a variation in pulsation depending on a variation in frequency when the connection pipe 260, which is a control group with respect to the experimental group, has a length of about 70 mm or less.

As illustrated in FIG. 14, it is seen that the pulsation when the connection pipe 260 has a length of about 75 mm is generally lower than that when the connection pipe 260 has a length of about 65 mm. Thus, in the current embodiment, the connection pipe 260 may have a length of about 70 mm to about 80 mm, for example, about 75 mm.

Figure 15:
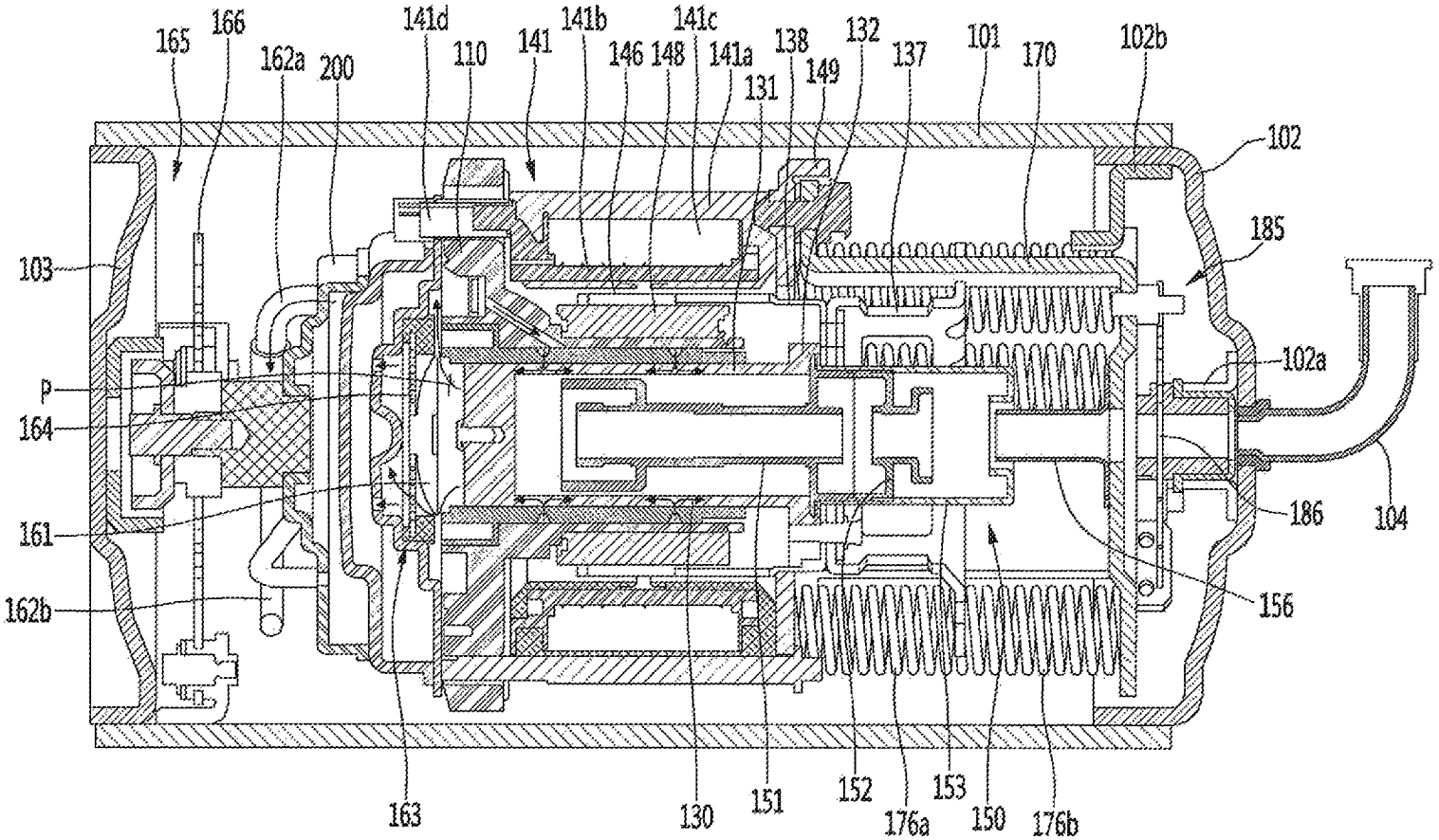
FIG. 15 is a cross-sectional view illustrating a state in which a refrigerant flows in the linear compressor according to an embodiment.

FIG. 15 is a cross-sectional view illustrating a state in which the refrigerant flows in the linear compressor according to an embodiment. Referring to FIG. 15, a refrigerant flow in the linear compressor 10 according to an embodiment will be described hereinafter. The refrigerant suctioned into the shell 101 through the suction pipe 104 may be introduced into the piston 130 via the suction muffler 150. The piston 130 reciprocates in the axial direction by the driving of the motor assembly 140.

When the suction valve 135 coupled to the front side of the piston 130 is opened, the refrigerant may be introduced into the compression space P and then compressed. Also, when the discharge valve 161 is opened, the compressed refrigerant may be introduced into the discharge space of the discharge cover 200.

The refrigerant may flow to the first space part 210*a* of the first cover 210 and then flow to the second space part 230*a* of the second cover 230 through the first and second discharge holes 216*a* and 216*b* (see FIG. 7). Also, the refrigerant within the second space part 230*a* may be discharged to the outside of the second cover 230 through the first pipe 261 of the connection pipe 260 (see FIGS. 8 and 11) and then introduced into the third space part 250*a* of the third cover 250 via the second pipe 263 and the third pipe 265 (see FIG. 7). The refrigerant within the third space part 250*a* may be discharged from the discharged cover 200 through the cover pipe 162*a* and then discharge to the outside of the linear compressor 10 via the loop pipe 162*b* and the discharge pipe 105 (see FIGS. 7 and 8).

As described above, pulsation of the compressed refrigerant discharged through the discharge valve may be reduced by the discharge cover including the plurality of covers which may be stacked in the axial direction, and thus, noise may be reduced.

According to embodiments, the compressor including internal parts or components may be decreased in size to reduce a volume of a machine room of a refrigerator, and thus, an inner storage space of the refrigerant may be increased. Also, a drive frequency of the compressor may be increased to prevent the internal parts from being deteriorated in performance due to the decreasing size thereof. In addition, the gas bearing may be applied between the cylinder and the piston to reduce a friction force occurring due to oil.

As the plurality of covers that respectively define the discharge spaces are provided in the discharge cover, the discharge space may be increased in volume, and thus, the pulsation of the discharged refrigerant may be reduced. Also, as the plurality of covers are may be stacked in the axial direction, a volume of the entire discharge cover may be relatively small while the discharge space is increased in volume to improve space availability. Also, noise generated by the flowing refrigerant may be effectively blocked through the structure of the stacked covers.

As a ratio of sizes of the first to third space parts, which are defined by the first to third covers, may be determined to be in an optimal range, a reduction effect of pulsation and noise may be superior. In particular, as the first space part is defined in the first cover, the second space part is defined between the outer surface of the first cover and the inner surface of the second cover, and the third space part is defined between the outer surface of the second cover and the inner surface of the third cover, a separate constitution for defining the discharge space in the discharge cover may be unnecessary.

Further, as the connection pipe connecting the second space part to the third space part has a relatively long length, the discharge passage may be increased in length, and thus, pulsation of the refrigerant may be reduced. Furthermore, as the connection pipe is inserted into the second cover, and the end of the connection pipe is spaced a preset or predetermined distance from the outer surface of the first cover, a pressure loss of the flowing refrigerant may be reduced.

Embodiments provide a linear compressor in which a discharge space of a discharge cover is improved in structure to reduce an occurrence of pulsation due to a flow of a refrigerant. Embodiments also provide a linear compressor in which a plurality of discharge spaces (or discharge chambers) are provided in a discharge cover.

Embodiments also provide a linear compressor in which a passage of a refrigerant flowing through a plurality of discharge spaces increased in length to reduce an occurrence of pulsation. Embodiments also provide a linear compressor in which an optical range with respect to a volume ratio of the plurality of discharge spaces is proposed to reduce an occurrence of pulsation.

Embodiments also provide a linear compressor in which an optimal range with respect to a shape or length of a connection pipe through which one discharge space of a plurality of discharge spaces communicates with the other discharge space is proposed to reduce an occurrence of pulsation.

In one embodiment, a linear compressor may include a discharge cover including a plurality of covers which may be stacked in an axial direction. The discharge cover may include a first cover having a first space part or space through which a refrigerant may flow. A spring assembly may be installed on the first cover.

The discharge cover may further include a second cover coupled to the first cover and having a second space part through which the refrigerant flows. The first cover may include a discharge hole through which the refrigerant within the first space part is transferred to the second space part.

The first cover may have a structure which may be stepped several times. The first cover may have a recess part or recess to which an outer circumferential surface of the spring assembly is coupled.

The discharge cover may further include a third cover coupled to the second cover and having a third space part or space through which the refrigerant may flow. The discharge cover may further include a connection pipe that extends from the second cover and is coupled to the third cover to transfer the refrigerant within the second space part to the third space part.

The connection pipe may have a shape which may be bent several times. The connection pipe may be coupled to the second cover to extend toward the first space part, and an end of a first pipe may be spaced a preset or predetermined distance (H1) from an outer surface of the first cover.

In another embodiment, a linear compressor may include a discharge cover. The discharge cover may include a first cover having a first space part or space, a second cover coupled to a front portion of the first cover and having a second space part or space, and a third cover coupled to a front portion of the second cover and having a third space part or space. The second space part may have a volume greater than that of each of the first space part and the third space part.

The details of one or more embodiments are set forth in the accompanying drawings and the description. Other features will be apparent from the description and drawings, and from the claims.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor, comprising:

a cylinder having a compression space for a refrigerant and into which a piston that reciprocates in an axial direction is inserted;

a discharge valve provided for the refrigerant at one side of the cylinder to selectively discharge the refrigerant compressed in the compression space;

a spring assembly coupled to the discharge valve; and a discharge cover on which the spring assembly is seated, the discharge cover having a discharge space through Which the refrigerant discharged through the discharge valve flows, wherein the discharge cover includes a plurality of covers stacked in the axial direction, and wherein the plurality of covers includes:

a first cover on which the spring assembly is seated and having a first space through which the refrigerant flows;

a second cover coupled to the first covet and having a second space through which the refrigerant flows;

a third cover coupled to the second cover and having a third space through which the refrigerant flows;

a connection pipe that extends from the second cover and is coupled to the third cover, the connection pipe having a first end disposed in the second space and a second end coupled to the third cover, wherein the connection pipe includes:

a first pipe that defines the first end of the connection pipe and extends from the second cover outward, the first pipe being configured to allow the refrigerant to discharge from the second space towards an outside of the second cover;

a second pipe bent from the first pipe; and a third pipe that is bent from the second pipe and defines the second end of the connection pipe; and a cover pipe coupled to the third cover, the cover pipe being configured to allow the refrigerant to discharge from the third space towards an outside of the third cover, wherein the second end of the connection pipe is fixed to a surface of the third cover to allow the refrigerant to be introduced into the third space from the outside of the third cover, and wherein the cover pipe is fixed to the surface of the third cover.

2. The linear compressor according to claim 1, wherein a sum of lengths of the first to third pipes ranges from 70 mm to 80 mm.

3. The linear compressor according to claim 1, wherein the first space, the second space, and the third space have a volume ratio of 1:2.5:1.

4. The linear compressor according to claim 1, wherein the third cover further includes a coupling hole provided in an approximately central portion of the third cover, and wherein a support coupling that supports the discharge cover is coupled to the coupling hole.

5. The linear compressor according to claim 1, further including a loop pipe coupled to the cover pipe to transfer the refrigerant flowing through the cover pipe to a discharge pipe.

6. The linear compressor according to claim 5, wherein the loop pipe includes a cover coupling portion coupled to the cover pipe and a discharge coupling portion coupled to the discharge pipe.

7. The linear compressor according to claim 1, wherein the first pipe extends from the second cover in a first direction, the second pipe extends from the first pipe in a second direction, and the third pipe extends from the second pipe in a third direction.

8. The linear compressor according to claim 7, wherein the first direction is a direction which extends away from the second cover, the second direction is a direction which extends approximately perpendicular to the first direction, and the third direction is a direction which extends approximately perpendicular to the second direction.

9. The linear compressor according to claim 1, wherein the connection pipe is coupled to the second cover to extend toward the first space, and an end portion of the first pipe is spaced a predetermined distance from an outer surface of the first cover.

10. The linear compressor according to claim 9, wherein the predetermined distance ranges from 1 mm to 2 mm.

11. The linear compressor according to claim 1, wherein the first cover includes at least one discharge hole through which the refrigerant in the first space is transferred to the second space.

12. The linear compressor according to claim 11, wherein the first cover further includes:

a first portion coupled to a frame;

a first step that extends to be stepped from the first portion; and a second portion that extends from the first step in a radial direction, and wherein the cylinder is inserted into the frame.

13. The linear compressor according to claim 12, wherein the at least one discharge hole includes a first discharge hole, and wherein the second portion includes the first discharge hole through which the refrigerant in the first space is transferred to the second space.

14. The linear compressor according to claim 13, wherein the first cover further includes:

a second step that extends to be stepped from the second portion; and a recess defined in the second step and coupled to an outer circumferential surface of the spring assembly.

15. The linear compressor according to claim 14, wherein the first cover further includes a third portion that extends from the second step in the radial direction, and wherein a surface of the spring assembly is provided in the third portion.

16. The linear compressor according to claim 15, wherein the first cover further includes:

a third step that extends to be stepped from the third portion; and a fourth portion that extends from the third step in the radial direction.

17. The linear compressor according to claim 16, wherein the at least one discharge hole further includes a second discharge hole, and wherein the fourth portion includes the second discharge hole through which the refrigerant in the first space is transferred to the second space.

18. The linear compressor according to claim 16, wherein the fourth portion includes a stopper provided on an approximately central portion of the fourth portion, and wherein the stopper protrudes toward the spring assembly to protect the spring assembly and the discharge valve when a degree of opening of the discharge valve is greater than a predetermined degree.

* * * * *